US007228700B2

(12) United States Patent
Matsumoto et al.

(10) Patent No.: US 7,228,700 B2
(45) Date of Patent: Jun. 12, 2007

(54) HEATING/COOLING SYSTEM

(75) Inventors: Kenzo Matsumoto, Gunma-ken (JP); Yoshio Watabe, Gunma-ken (JP); Hiroshi Nishikawa, Tatebayashi (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 300 days.

(21) Appl. No.: 11/055,072

(22) Filed: Feb. 11, 2005

(65) Prior Publication Data

US 2005/0178141 A1 Aug. 18, 2005

(30) Foreign Application Priority Data

Feb. 12, 2004 (JP) ..... 2004-35409
Feb. 12, 2004 (JP) ..... 2004-035441

(51) Int. Cl.
*F25B 15/00* (2006.01)

(52) U.S. Cl. ..... 62/324.1; 62/324.6

(58) Field of Classification Search ..... 62/324.1, 62/324.6, 498, 513
See application file for complete search history.

(56) References Cited

U.S. PATENT DOCUMENTS 6,343,486 B1 * 2/2002 Mizukami ..... 62/509
2004/0020230 A1 * 2/2004 Kuwabara et al. ..... 62/238.6
2004/0134225 A1 * 7/2004 Sakamoto et al. ..... 62/498

FOREIGN PATENT DOCUMENTS

JP 6-18156 1/1994

* cited by examiner

*Primary Examiner*—Melvin Jones
(74) *Attorney, Agent, or Firm*—Armstrong, Kratz, Quintos, Hanson & Brooks, LLP

(57) ABSTRACT

An object is to provide a heating/cooling system capable of achieving reduction of power consumption, and enhancement of performance in a heating/cooling system usable in such a manner as to be switched to be hot/cold. The heating/cooling system having a storage chamber usable in such a manner as to be switched to be hot/cold, comprises: a refrigerant circuit comprising a compressor, a gas cooler, a pressure reducing device, an evaporator and the like, containing carbon dioxide sealed as a refrigerant therein, and having a supercritical pressure on a high-pressure side; a radiator through which the refrigerant flowing out of the gas cooler flows before entering the pressure reducing device; and an air blower which sends air through the gas cooler, the inside of the storage chamber is heated by the radiator, the inside of the storage chamber is cooled by the evaporator, and the air blower is stopped in a case where the inside of the storage chamber is heated by the radiator.

7 Claims, 17 Drawing Sheets

HEATING/COOLING SYSTEM

BACKGROUND OF THE INVENTION

1. Field of the Invention

The present invention relates to a heating/cooling system having a storage chamber usable in a switched hot/cold state.

2. Description of the Related Art

As shown in FIG. 17, this type of heating/cooling system has heretofore comprised a storage chamber 101 partitioned into a cooling chamber 102 and a heating chamber 103 by an insulated wall, and a machine chamber 109 disposed under the storage chamber 101. Moreover, the machine chamber 109 contains a compressor 111, a gas cooler 112, a capillary tube 116 which is pressure reduction means and the like, and constitutes a refrigerant circuit 110 together with an evaporator 117. An electric heater 180 is disposed in the heating chamber 103, and air heated by the electric heater 180 is sent into the heating chamber 103 by a fan 128 to thereby heat the heating chamber 103.

Here, an operation of a conventional heating/cooling system 400 will be described with reference to FIG. 17. When an operation of the fan 128 is started by a control device (not shown), and electric power is supplied to the electric heater 180, the air heated by the electric heater 180 is circulated in the heating chamber 103 by the fan 128. Accordingly, the inside of the heating chamber 103 is heated.

Moreover, the control device starts the operation of a fan 127, and starts a driving element (not shown) of the compressor 111. Accordingly, a low-pressure refrigerant gas is sucked and compressed in a cylinder of a compression element (not shown) of the compressor 111 to constitute a high-temperature/pressure refrigerant gas, and the gas is discharged to the gas cooler 112.

Furthermore, the refrigerant gas releases heat by the gas cooler 112, and enters the capillary tube 116 via an internal heat exchanger 145, the pressure is lowered in the tube, and the gas flows into the evaporator 117. There the refrigerant evaporates, and absorbs the heat from ambient air to thereby perform a cooling function. It is to be noted that the air cooled by evaporation of the refrigerant in the evaporator 117 is circulated in the cooling chamber 102 by the operation of the fan 127 to cool the inside of the cooling chamber 102. Thus, in the conventional heating/cooling system, the inside of the heating chamber 103 has heretofore been heated by the electric heater 180, and the cooling chamber 102 is cooled by the evaporator 117 of the refrigerant circuit 110 (see, e.g., Japanese Patent Application Laid Open No. 6-18156).

Here, in recent years, a hot/cold switch-usable heating/cooling system has also been developed in which both a heating member such as an electric heater, and an evaporator are disposed in one storage chamber. When the storage chamber is heated, a heater is operated to heat the storage chamber. When the storage chamber is cooled, the operation of the electric heater is stopped, the operation of the compressor is started, and the refrigerant is evaporated by the evaporator to cool the storage chamber. However, as described above, the storage chamber is heated by a heating member such as an electric heater, and therefore a problem has occurred that power consumption remarkably increases.

SUMMARY OF THE INVENTION

An object of the present invention is to reduce power consumption and enhance performance in a hot/cold switch-usable heating/cooling system in order to solve the above-described technical problems.

According to the present invention, there is provided a heating/cooling system having a storage chamber usable in such a manner as to be switched to be hot/cold, comprising: a refrigerant circuit comprising a compressor, a gas cooler, a pressure reducing device, an evaporator and the like, containing carbon dioxide sealed as a refrigerant therein, and having a supercritical pressure on a high-pressure side; a radiator through which the refrigerant flowing out of the gas cooler flows before entering the pressure reducing device; and an air blower which sends air through the gas cooler, the inside of the storage chamber being heated by the radiator, the inside of the storage chamber being cooled by the evaporator, and the air blower being stopped in a case where the inside of the storage chamber is heated by the radiator.

According to the heating/cooling system of the present invention, carbon dioxide having satisfactory heating characteristic is used as the refrigerant. Accordingly, to cool the inside of the storage chamber, the inside is cooled by the evaporator. To heat the inside of the storage chamber, the inside of the storage chamber can be heated by the refrigerant passed through the gas cooler on the high-pressure side. Accordingly, since the inside of the storage chamber can be heated without using any heating member such as an electric heater, power consumption can be reduced as compared with the heating by the electric heater.

Especially, when the inside of the storage chamber is heated by the radiator, the air blower is stopped. Therefore, heat is conveyed to the radiator without radiating the heat from the refrigerant in the gas cooler, and a heating capability inside the storage chamber can be enhanced.

Moreover, in the heating/cooling system of the present invention, the compressor in the above-described invention comprises first and second compression elements, and the second compression element compresses the refrigerant compressed by the first compression element. The compressor comprises an intermediate cooling circuit comprising a heat exchanger for cooling the refrigerant compressed by the first compression element, and allowing the second compression element to suck the refrigerant, and the heat exchanger is integrally disposed in the gas cooler.

According to the present invention, in addition to the above-described invention, when a two-stage compression system compressor comprising so-called intermediate cooling circuit is used, to heat the inside of the storage chamber, heat radiation in the heat exchanger of the intermediate cooling circuit is invalidated, and the heat can be conveyed to the radiator.

Moreover, in the above-described inventions, the heating/cooling system of the present invention further comprises an internal heat exchanger for exchanging the heat between the refrigerant which has flown out of the gas cooler and the refrigerant which has flown out of the evaporator, and the refrigerant is passed through the radiator before reaching the internal heat exchanger.

According to the present invention, in addition to the above-described inventions, the system comprises the internal heat exchanger for exchanging the heat between the refrigerant which has flown out of the gas cooler and the refrigerant which has flown out of the evaporator. In this case, the refrigerant is passed through the radiator before reaching the internal heat exchanger. Therefore, the inside of the storage chamber can be heated by the refrigerant before the temperature of the refrigerant drops in the internal heat exchanger.

Moreover, in the above-described inventions, the heating/cooling system of the present invention comprises channel control means for controlling refrigerant circulation into the radiator and the evaporator, and an evaporator is separately disposed for passing the refrigerant through the radiator, and evaporating the refrigerant in a case where the refrigerant circulation into the evaporator is interrupted.

According to the present invention, in addition to the above-described inventions, in a case where the inside of the storage chamber is heated, the refrigerant circulation into the evaporator is broken by the channel control means, and the refrigerant can be evaporated by the separately disposed evaporator. Therefore, even when the radiator and evaporator for heating/cooling the inside of the storage chamber are disposed in the storage chamber, the storage chamber can be heated/cooled without any trouble.

Moreover, according to the present invention, there is provided a heating/cooling system having a storage chamber usable in such a manner as to be switched to be hot/cold, comprising: a refrigerant circuit comprising a compressor, a radiator, a pressure reducing device, an evaporator and the like, containing carbon dioxide sealed as a refrigerant therein, and having a supercritical pressure on a high-pressure side; and a partition member capable of dividing the storage chamber in an insulated manner so that the inside of the storage chamber is heated by the radiator, and cooled by the evaporator. The partition member divides the storage chamber in such a manner that one chamber is heated by the radiator, and the other chamber is cooled by the evaporator.

According to the heating/cooling system of the present invention, the inside of the storage chamber can be heated by the radiator, and cooled by the evaporator using carbon dioxide having a satisfactory heating characteristic as the refrigerant. Accordingly, the inside of the storage chamber can be heated without using any heating member such as an electric heater. Even when the heating member including the electric heater or the like is used, a capacity of the heating member can be reduced, and therefore the power consumption can be reduced.

Furthermore, when the storage chamber is divided by the partition member, a ratio of a heating region in which the inside of the storage chamber is heated by the radiator to a cooling region in which the inside of the storage chamber is cooled by the evaporator can be changed.

Moreover, in the above-described inventions, the heating/cooling system of the present invention further comprises: a gas cooler for radiating heat from the refrigerant; a separate evaporator for evaporating the refrigerant; and channel control means for controlling refrigerant circulation with respect to the radiator, the gas cooler, and both the evaporators.

According to the present invention, in addition to the above-described inventions, when the channel control means is controlled, the heat is radiated from the refrigerant by the gas cooler, the refrigerant is evaporated by the evaporator for cooling the storage chamber, and then the whole storage chamber can be cooled.

Moreover, when the channel control means is controlled, the heat is radiated from the refrigerant by the radiator, the refrigerant is evaporated by the evaporator disposed separately from the evaporator for cooling the storage chamber, and then the whole storage chamber can be heated.

Accordingly, the inside of the storage chamber can be entirely heated or cooled, and convenience of the heating/cooling system can be enhanced.

Furthermore, in the heating/cooling system of the present invention, the compressor in the above-described invention comprises first and second compression elements; and an intermediate cooling circuit for cooling the refrigerant compressed by the first compression element of the compressor, and thereafter allowing the second compression element to suck the refrigerant. In a case where the inside of the storage chamber is heated by the radiator, the cooling of the refrigerant in the intermediate cooling circuit is substantially invalidated.

According to the present invention, in addition to the above-described inventions, after cooling the refrigerant compressed by the first compression element, the refrigerant is sucked into the second compression element by the intermediate cooling circuit. Therefore, the temperature of the refrigerant gas discharged from the second compression element of the compressor can be lowered. Accordingly, the cooling capability can be enhanced.

Furthermore, when the inside of the storage chamber is heated by the radiator, the cooling of the refrigerant in the intermediate cooling circuit is substantially invalidated. Accordingly, the refrigerant gas discharged from the second compression element of the compressor can be maintained at high temperature, and the heating capability in the radiator can be improved.

DETAILED DESCRIPTION OF THE PREFERRED EMBODIMENTS

Embodiments of the present invention will be described hereinafter with reference to the drawings.

(Embodiment 1)

Figure 1:
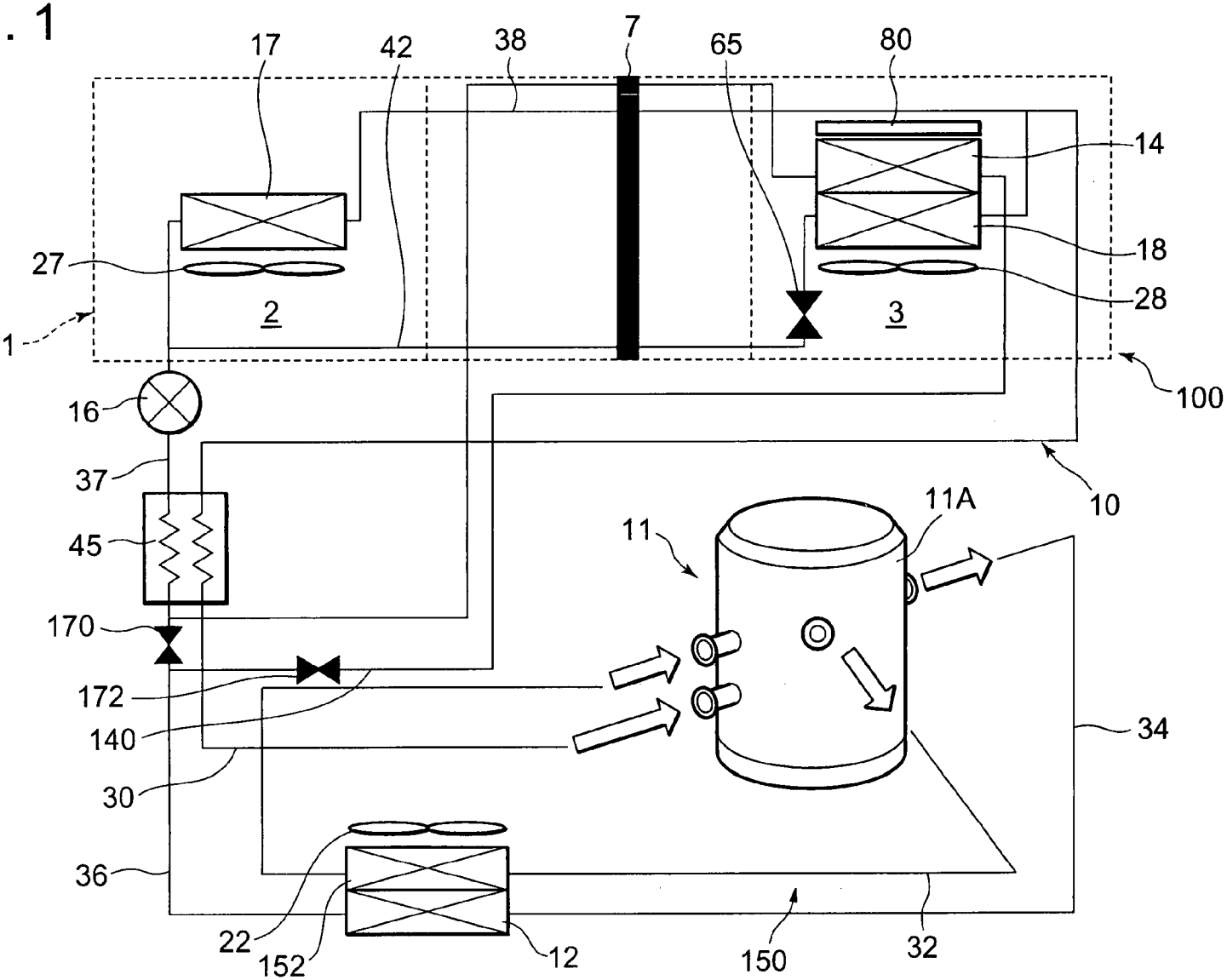
FIG. 1 is a refrigerant circuit diagram of a heating/cooling system of one embodiment of the present invention (Embodiment 1)

FIG. 1 is a schematic constitution diagram of a heating/cooling system 100 according to one embodiment to which the present invention has been applied. It is to be noted that the heating/cooling system of the present invention is usable in a showcase, an automatic vending machine, an air conditioner, a cold/hot storage or the like.

In FIG. 1, reference numeral 1 denotes a storage chamber of the heating/cooling system 100, and the storage chamber 1 is surrounded with an insulating member. The inside of the storage chamber 1 is divided by an insulated wall 7, one chamber (on the left side of the insulated wall 7 in FIG. 1) is used as a cooling chamber 2, and the other chamber (on the right side of the insulated wall 7 in FIG. 1) is used as a storage chamber 3.

In the cooling chamber 2, an evaporator 17 for evaporating refrigerant, and a fan 27 for sending (circulating) air which has exchanged heat with the evaporator 17 to the cooling chamber 2 are disposed. It is to be noted that the evaporator 17 is disposed separately from an evaporator 18 described later. The refrigerant can be evaporated by the evaporator 17 even in a case where refrigerant circulation into the evaporator 18 is interrupted by the evaporator 17.

Moreover, in the storage chamber 3, a radiator 14, an electric heater 80, the above-described evaporator 18, and a fan 28 for sending (circulating) the air which has exchanged heat with the radiator 14 or the evaporator 18, or air heated by the electric heater 80 into a chamber 4 are disposed. Moreover, the inside of the storage chamber 3 is heated by the radiator 14, and the inside of the storage chamber 3 is cooled by the evaporator 18. It is to be noted that the electric heater 80 heats the inside of the storage chamber 3, and the electric heater 80 can compensate the heating in the storage chamber 3 by the radiator 14.

On the other hand, in FIG. 1, reference numeral 10 denotes a refrigerant circuit, and comprises a compressor 11, a gas cooler 12, the radiator 14, an expansion valve 16 which is a pressure reducing device, the evaporators 17 and 18 and the like.

That is, a refrigerant discharge tube 34 of the compressor 11 is connected to an inlet of the gas cooler 12. Here, the compressor 11 of the present embodiment is an internal intermediate pressure type two-step compression system rotary compressor, has a driving element (not shown), and first and second rotary compression elements (not shown) driven by this driving element in a sealed container 11A, and is constituted in such a manner as to compress the refrigerant compressed by the first rotary compression element by the second rotary compression element.

In the figure, reference numeral 30 denotes a refrigerant introducing tube for introducing the refrigerant to the first rotary compression element of the compressor 11, and one end of the refrigerant introducing tube 30 communicates with a cylinder of the first rotary compression element. The other end of the refrigerant introducing tube 30 is connected to an outlet of an internal heat exchanger 45 described later.

In the figure, reference numeral 32 denotes a refrigerant introducing tube for introducing the refrigerant compressed by the first rotary compression element to the second rotary compression element. The refrigerant introducing tube 32 is disposed in such a manner as to pass through an intermediate cooling circuit 150 outside the compressor 11. Here, the intermediate cooling circuit 150 is a refrigerant circuit comprising a heat exchanger 152 for cooling the refrigerant compressed by the first rotary compression element, and thereafter allowing the second rotary compression element to suck the refrigerant. That is, the refrigerant compressed by the first rotary compression element is allowed to flow into the intermediate cooling circuit 150 outside the compressor 11 from the refrigerant introducing tube 32, cooled while passing,through the radiator 14, and sucked into the second rotary compression element. The heat exchanger 152 is disposed integrally with the gas cooler 12, and also serves as an air blower 22 for passing air through the gas cooler 12.

The refrigerant discharge tube 34 is a refrigerant pipe for discharging the refrigerant compressed by the second rotary compression element to the gas cooler 12.

A refrigerant pipe 36 connected to the outlet of the gas cooler 12 is connected to the internal heat exchanger 45. The internal heat exchanger 45 exchanges heat between the refrigerant which has flown out of the gas cooler 12 on a high-pressure side, and the refrigerant which has flown out of the evaporator 17 or 18 on a low-pressure side. A refrigerant pipe 37 connected to the outlet of the internal heat exchanger 45 is connected to an inlet of the evaporator 17 of the cooling chamber 2 via the expansion valve 16.

Here, a first bypass circuit 140 is branched midway in the refrigerant pipe 36. The first bypass circuit 140 is disposed, in such a manner as to extend through the radiator 14 disposed in the storage chamber 3, and the refrigerant which has flown out of the gas cooler 12 before entering the expansion valve 16 and before reaching the internal heat exchanger 45 can be passed through the radiator 14 by the first bypass circuit 140.

Moreover, the first bypass circuit 140 extending from the radiator 14 is connected to the refrigerant pipe 36 on the outlet side of an electromagnetic valve 170 on an inlet side of the internal heat exchanger 45. The electromagnetic valve 170 and another electromagnetic valve 172 are disposed as channel control means for controlling refrigerant circulation into the radiator 14 in a piping on a downstream side of a branch of the first bypass circuit 140 of the refrigerant pipe 36, and on the inlet side of the radiator 14 of the first bypass circuit 140. The electromagnetic valves 170 and 172 are controlled in such a manner as to open/close by a control device (not shown). It is to be noted that the refrigerant circulation into the radiator 14 is not limited to control of the respective electromagnetic valves 170 and 172, and the refrigerant circulation into the radiator 14 may be controlled using and switching a three-way valve.

Moreover, a second bypass circuit 42 is branched from a middle portion of the refrigerant pipe 37 extending from the expansion valve 16. The second bypass circuit 42 is disposed in such a manner as to pass through the evaporator 18 disposed in the storage chamber 3, and thereafter extend together with a refrigerant pipe 38 extending from the evaporator 17. In a piping on the inlet side of the evaporator 18, an electromagnetic valve 65 is disposed as the channel control means for controlling the refrigerant circulation into the evaporator 18.

Here, in the refrigerant circuit 10, carbon dioxide ($CO_2$) which is ecological for global environment as the refrigerant and which is natural refrigerant is sealed in consideration of combustibility, toxicity and the like, and the circuit has a supercritical pressure on a high-pressure side.

Moreover, the above-described electromagnetic valves 65, 170, 172 are controlled in such a manner as to open/close by control devices (not shown), respectively. It is to be noted that the control device is control means for controlling the heating/cooling system 100, and in addition to the respective electromagnetic valves 65, 170, 172, operations of the compressor 11, air blower 22, fans 27, 28 and the like are also controlled.

(1) Mode to Use Storage Chamber 3 as Cooling Chamber

Figure 2:
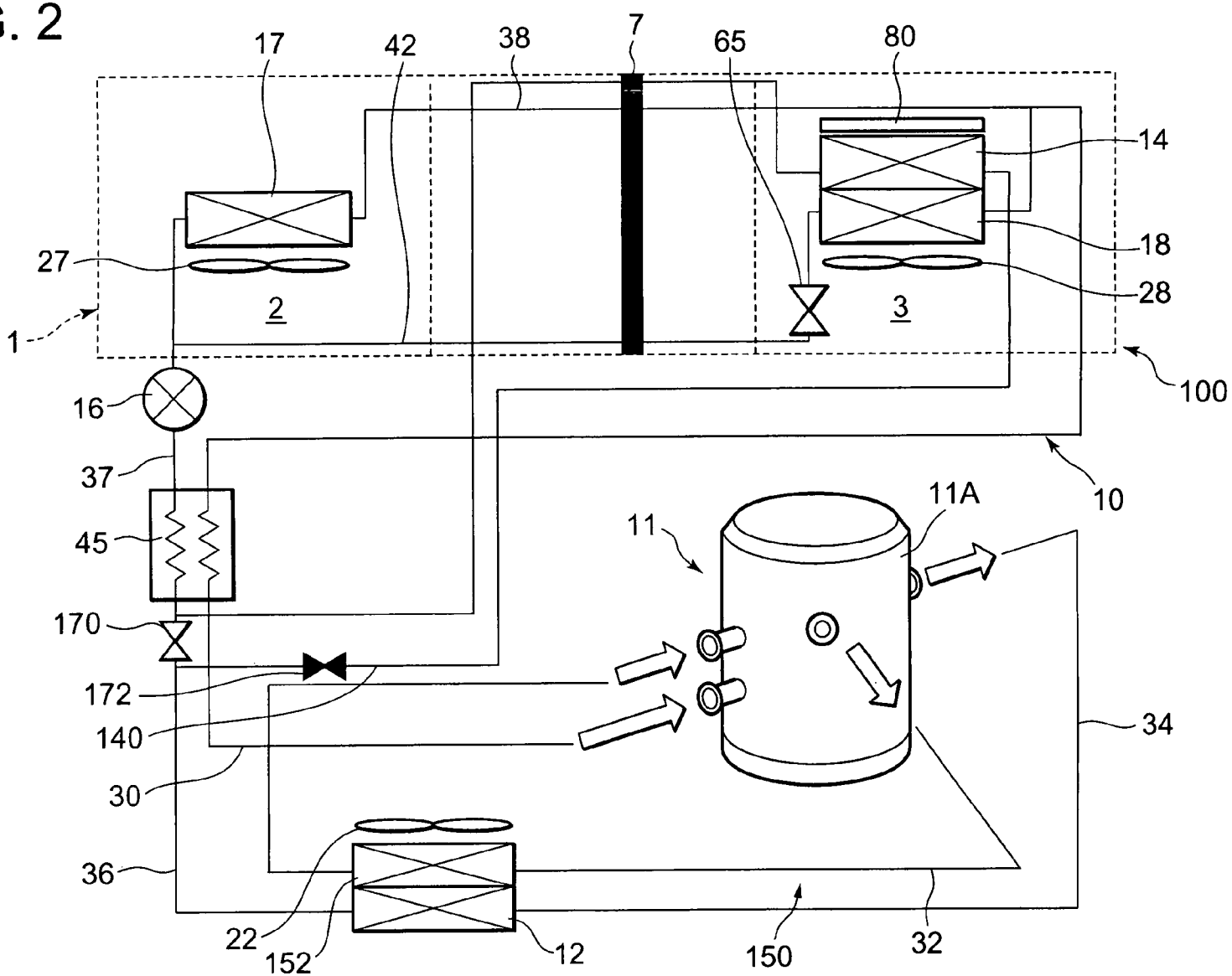
FIG. 2 is a refrigerant circuit diagram showing a flow of refrigerant in a mode in which a storage chamber 3 is used as a cooling chamber.

Next, an operation of the heating/cooling system 100 constituted as described above according to the present invention will be described. First, a mode to use the storage chamber 3 as the cooling chamber for cooling articles will be described with reference to FIG. 2. FIG. 2 is a refrigerant circuit diagram showing a flow of refrigerant in this mode.

The electromagnetic valve 170 is opened, the electromagnetic valve 172 is closed, and the first bypass circuit 140 is blocked by the control device (not shown). Accordingly, since the refrigerant circulation into the radiator 14 is interrupted, the refrigerant which has flown out of the gas cooler 12 does not flow into the radiator 14, and flows into the internal heat exchanger 45 as such. Moreover, the control device opens the electromagnetic valve 65 to open the second bypass circuit 42. Accordingly, the refrigerant from the expansion valve 16 flows into the evaporator 18. It is to be noted that in FIGS. 2 and 3 described hereinafter, a white electromagnetic valve indicates a state in which the valve is opened by the control device, and a black electromagnetic valve indicates a state in which the valve is closed by the control device.

Moreover, the control device starts the operations of the air blower 22 and the fans 27, 28, and drives the driving element of the compressor 11. Accordingly, the low-pressure refrigerant is sucked and compressed by the first rotary compression element of the compressor 11 to indicate an intermediate pressure, and is discharged into the sealed container 11A. The refrigerant discharged into the sealed container 11A is once discharged to the outside of the gas cooler 12 from the refrigerant introducing tube 32, and enters the intermediate cooling circuit 150. Moreover, the refrigerant receives air flow by the air blower 22 of the gas cooler 12 while passing through the heat exchanger 152.

When the refrigerant compressed by the first rotary compression element is cooled by the heat exchanger 152, and thereafter sucked by the second rotary compression element, the temperature of the refrigerant gas discharged from the second rotary compression element of the compressor 11 can be lowered. Accordingly, since evaporation temperature of the refrigerant in the respective evaporators 17, 18 drops, the cooling chamber 2 and the storage chamber 3 can be cooled at lower temperature. Therefore, cooling capabilities of the cooling chamber 2 and the storage chamber 3 by the respective evaporators 17, 18 can be enhanced.

Thereafter, the refrigerant is sucked and compressed by the second rotary compression element to constitute a high-temperature/pressure refrigerant gas, and discharged to the outside of the compressor 11 from the refrigerant discharge tube 34. At this time, the refrigerant is compressed to an appropriate supercritical pressure. The refrigerant gas discharged from the compressor 11 flows into the gas cooler 12 from the refrigerant discharge tube 34.

Here, the high-temperature/pressure refrigerant compressed by the compressor 11 does not condense, and operation is performed in a supercritical state. After the high-temperature/pressure refrigerant gas radiates heat by the gas cooler 12, the gas flows out of the gas cooler 12, and enters the refrigerant pipe 36. The refrigerant which has entered the refrigerant pipe 36 passes through the internal heat exchanger 45 as such without flowing through the first bypass circuit 140, because the electromagnetic valve 170 is opened and the electromagnetic valve 172 is closed as described above. The heat of the refrigerant is taken by the refrigerant flowing out of the evaporators 17, 18 on the low-pressure side, and the refrigerant is further cooled. By the presence of the internal heat exchanger 45, the heat of the refrigerant flowing out of the gas cooler 12 and passing through the internal heat exchanger 45 is taken by the refrigerant on the low-pressure side, and therefore super-cooling degree of the refrigerant increases the more. Therefore, the cooling capabilities in the respective evaporators 17, 18 are enhanced.

The refrigerant cooled by the internal heat exchanger 45 on the high-pressure side reaches the expansion valve 16. It is to be noted that the refrigerant still has a supercritical state in the inlet of the expansion valve 16. The refrigerant is brought into a two-phase mixed state of a gas/liquid by pressure drop in the expansion valve 16. Moreover, the refrigerant brought into the two-phase mixed state flows into the evaporator 17 disposed in the cooling chamber 2. There, the refrigerant evaporates, and absorbs the heat from ambient air to thereby exert a cooling function. It is to be noted that the air cooled by the evaporation of the refrigerant in the evaporator 17 is circulated through the cooling chamber 2 by the operation of the fan 27 to cool the inside of the cooling chamber 2.

At this time, by an effect to cool the refrigerant compressed by the first rotary compression element by the heat exchanger 152 as described above, and an effect to pass the refrigerant flowing out of the gas cooler 12 on the high-pressure side through the internal heat exchanger 45 to cool the refrigerant, the refrigerant evaporates at lower temperature by the evaporator 17. Accordingly, the cooling chamber 2 can be cooled at lower temperature, and the cooling capability can be enhanced. Moreover, the refrigerant which has evaporated in the evaporator 17 thereafter flows out of the evaporator 17, and enters the refrigerant pipe 38.

On the other hand, the electromagnetic valve 65 is opened as described above, and therefore a part of the refrigerant whose pressure has been reduced by the expansion valve 16 flows in the evaporator 18 installed in the storage chamber 3 from the second bypass circuit 42. Therefore, the refrigerant evaporates, and absorbs the heat from the ambient air to thereby exert a cooling function. The air cooled by the evaporation of the refrigerant in the evaporator 18 is circulated in the storage chamber 3 by the operation of the fan 28 to thereby cool the storage chamber 3.

Moreover, as described above, by the effect to cool the refrigerant compressed by the first rotary compression element by the heat exchanger 152, and the effect to pass the refrigerant which has flown out of the gas cooler 12 on the high-pressure side through the internal heat exchanger 45 to cool the refrigerant, the refrigerant evaporates at lower temperature in the evaporator 18. Accordingly, the inside of the storage chamber 3 can be cooled at lower temperature, and the cooling capability can be enhanced.

Moreover, the refrigerant which has flown out of the evaporator 18 flows together with the refrigerant flowing in the refrigerant pipe 38 from the evaporator 17, and reaches the internal heat exchanger 45.

There, the refrigerant takes the heat from the refrigerant on the high-pressure side, and is subjected to a heating function. Here, the refrigerant evaporates in the respective evaporators 17, 18 at the low temperature. The refrigerant which has flown out of the respective evaporators 17, 18 does not have a complete gas state, and the liquid is sometimes mixed. However, when the refrigerant is passed through the internal heat exchanger 45, and allowed to exchange the heat with the high-temperature refrigerant on the high-pressure side. Accordingly, the refrigerant is superheated, the superheating degree of the refrigerant is secured at this time, and the refrigerant completely turns to the gas.

Accordingly, the refrigerant which has flown out of the respective evaporators 17, 18 can be securely gasified. Therefore, without disposing any accumulator or the like on the low-pressure side, suction of liquid refrigerant into the compressor 11, that is, liquid backflow is securely prevented. A disadvantage that the compressor 11 is damaged by liquid compression can be avoided. Therefore, reliability of the heating/cooling system 100 can be enhanced.

It is to be noted that the refrigerant which has been heated by the internal heat exchanger 45 repeats a cycle to be sucked into the first rotary compression element of the compressor 11 from the refrigerant introducing tube 30.

Thus, the air blower 22 is operated to radiate the heat from the refrigerant in the gas cooler 12, and the electromagnetic valve 172 is closed to thereby interrupt the refrigerant circulation into the radiator 14. Accordingly, even when the radiator 14 and evaporator 18 for heating/cooling the inside of the storage chamber 3 are disposed in the storage chamber 3, the storage chamber 3 can be cooled without any trouble.

(2) Mode in Which Storage Chamber 3 is Used as Heating Chamber

Figure 3:
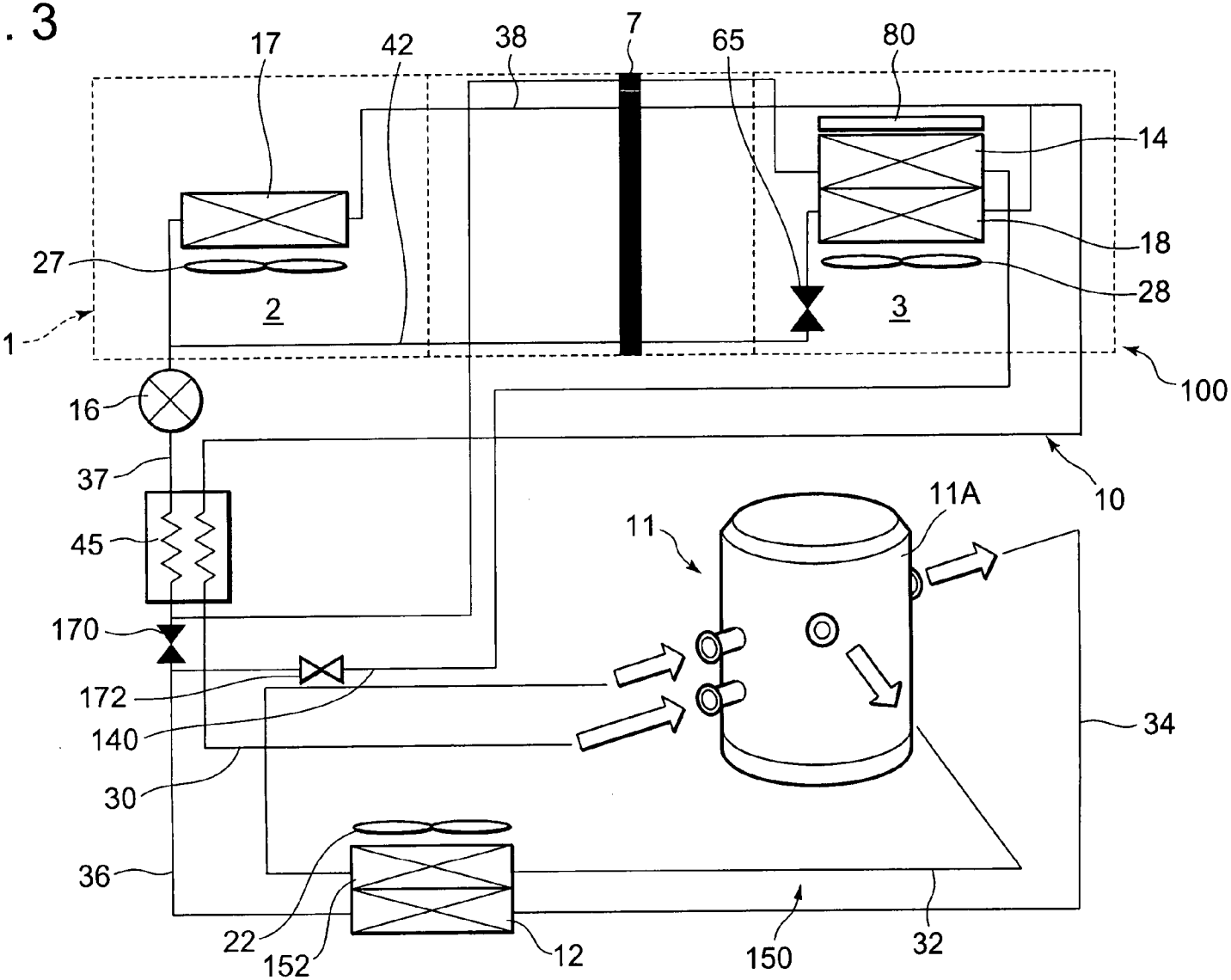
FIG. 3 is a refrigerant circuit diagram showing a flow of refrigerant in a mode in which the storage chamber 3 of FIG. 1 is used as a heating chamber.

Next, a mode in which the storage chamber 3 is used as the heating chamber for heating the articles will be described with reference to FIG. 3. FIG. 3 is a refrigerant circuit diagram showing a flow of refrigerant in this mode.

The electromagnetic valve 170 is closed by the control device (not shown), and the electromagnetic valve 172 is opened to thereby open the first bypass circuit 140. Accordingly, the refrigerant from the gas cooler 12 does not flow in the internal heat exchanger 45 as such, and all flows in the first bypass circuit 140 from the middle portion of the refrigerant pipe 36.

Moreover, the control device closes the electromagnetic valve 65, and blocks the second bypass circuit 42. Accordingly, all the refrigerant from the expansion valve 16 flows in the evaporator 17. Furthermore, the control device starts the operations of the fans 27, 28. At this time, it is assumed that the air blower 22 of the gas cooler 12 is not operated.

Furthermore, when the driving element of the compressor 11 is driven by the control device, the low-pressure refrigerant gas is sucked into the first rotary compression element (not shown) of the compressor 11 from the refrigerant introducing tube 30, compressed to indicate an intermediate pressure, and discharged into the sealed container 11A. The refrigerant discharged into the sealed container 11A is once discharged to the outside of the sealed container 11A from the refrigerant introducing tube 32, enters the intermediate cooling circuit 150, and passes through the heat exchanger 152. It is to be noted that in the present mode, the air blower 22 is not operated as described above. Therefore, the heat radiation of the refrigerant in the heat exchanger 152 slightly or hardly occurs. Thus, when the air blower 22 is stopped, and the heat radiation in the heat exchanger 152 of the intermediate cooling circuit 150 is substantially invalidated, the refrigerant sucked into the second rotary compression element can be held at high temperature. Therefore, the refrigerant discharged from the compressor 11 is at high temperature, and the heat can be conveyed to the radiator 14. Accordingly, the heating capability in the radiator 14 can be secured.

Thereafter, the refrigerant is sucked into the second rotary compression element, compressed to form a high-temperature/pressure refrigerant gas, and discharged to the outside of the compressor 11 from the refrigerant discharge tube 34. At this time, the refrigerant is compressed to an appropriate supercritical pressure. The refrigerant gas discharged from the compressor 11 passes through the gas cooler 12. Since the air blower 22 is not operated as described above, the refrigerant in the gas cooler 12 slightly or hardly radiates heat.

Since the electromagnetic valve 170 is closed, and the electromagnetic valve 172 is opened as described above, the refrigerant which has flown out of the gas cooler 12 enters the first bypass circuit 140 from the refrigerant pipe 36, and flows in the radiator 14 disposed in the storage chamber 3. Here, the high-temperature/pressure refrigerant compressed by the compressor 11 does not condense, and is operated in a supercritical state. Moreover, the high-temperature/pressure refrigerant gas radiates the heat in the radiator 14. It is to be noted that the air heated by the heat radiation of the refrigerant in the radiator 14 is circulated in the storage chamber 3 by the operation of the fan 28 to thereby heat the inside of the storage chamber 3. In the present invention, since carbon dioxide is used as the refrigerant, the refrigerant does not condense in the radiator 14, therefore a heat exchange capability in the radiator 14 is remarkably high, and the air in the storage chamber 3 can be set at the high temperature.

Moreover, since the air blower 22 stops as described above, the refrigerant hardly radiates heat in the heat exchanger 152 and gas cooler 12 of the intermediate cooling circuit 150, and the refrigerant maintained at the high temperature can radiate the heat in the radiator 14. Since the heat can be conveyed to the radiator 14 in this manner, the heating capability in the radiator 14 can be sufficiently secured.

Furthermore, since the refrigerant can be passed through the radiator 14 before reaching the internal heat exchanger 45, the inside of the storage chamber 3 can be heated by the refrigerant before the temperature drops in the internal heat exchanger 45. Accordingly, the heating capability in the storage chamber 3 can be enhanced.

Therefore, the refrigerant enters the refrigerant pipe 36 on the outlet side of the electromagnetic valve 170 from the first bypass circuit 140, and passes through the internal heat exchanger 45. The heat of the refrigerant is taken by the refrigerant which has flown out of the evaporator 17 on the low-pressure side, and is further cooled. Moreover, the refrigerant gas on the high-pressure side cooled by the internal heat exchanger 45 reaches the expansion valve 16. It is to be noted that the refrigerant gas still has the supercritical state in the inlet of the expansion valve 16. The refrigerant is brought into a mixed state of two phases of gas/liquid by the pressure drop in the expansion valve 16. Moreover, since the electromagnetic valve 65 is closed as described above, all the refrigerant that has flown out of the expansion valve 16 flows in the evaporator 17 installed in the cooling chamber 2 without flowing through the second bypass circuit 42.

There, the refrigerant evaporates, and absorbs heat from the ambient air to thereby exert the cooling function. It is to be noted that the air cooled by the evaporation of the refrigerant in the evaporator 17 is circulated in the cooling chamber 2 to thereby cool the inside of the cooling chamber 2 by the operation of the fan 27. Moreover, the refrigerant flows out of the evaporator 17, enters the refrigerant pipe 38, and passes through the internal heat exchanger 45.

There, the refrigerant repeats a cycle of taking the heat from the refrigerant on the high-pressure side, receiving the heating function, and completely turning into the gas state to be sucked into the first rotary compression element of the compressor 11 from the refrigerant introducing tube 30.

Thus, the electromagnetic valve 65 is closed to thereby interrupt the refrigerant circulation into the evaporator 18, and the refrigerant is evaporated by the evaporator 17. Accordingly, even when the radiator 14 and evaporator 18 for heating/cooling the inside of the storage chamber 3 are disposed in the storage chamber 3, the storage chamber 3 can be heated without any trouble.

As described above in detail, when carbon dioxide having a satisfactory heating characteristic is used as the refrigerant, the inside of the storage chamber 3 is cooled by the evaporator 18, and the inside of the storage chamber 3 can be heated by the refrigerant passed through the gas cooler 12 on the high-pressure side. Accordingly, the inside of the storage chamber 3 can be heated without using any heating member such as an electric heater, and therefore power consumption can be saved as compared with the heating by the electric heater.

Especially, in a case where the inside of the storage chamber 3 is heated by the evaporator 18, the air blower 22 is stopped, therefore the heat is conveyed to the evaporator 18 without radiating the heat from the refrigerant in the gas cooler 12, and the heating capability in the storage chamber 3 can be enhanced.

Furthermore, in a case where the inside of the storage chamber 3 is heated by the evaporator 18, the heat radiation in the heat exchanger 152 of the intermediate cooling circuit 150 is invalidated, the heat can be conveyed to the evaporator 18 the more, and the heating capability can be further enhanced.

Furthermore, when the opening/closing of the respective electromagnetic valves 170, 172, 65, and the operation of the air blower 22 are controlled, the heating/cooling in the storage chamber 3 can be freely switched. Accordingly, convenience of the heating/cooling system 100 can be enhanced. Furthermore, even when the radiator 14 and evaporator 18 for heating/cooling the inside of the storage chamber 3 are disposed in the storage chamber 3 as in the present embodiment, the storage chamber 3 can be heated/cooled without any trouble.

Moreover, when the gas cooler 12 is integrally formed with the heat exchanger 152 as in the present embodiment, an installation space can be reduced. Furthermore, since the air blower 22 of the gas cooler 12 can be used also for the heat exchanger 152 by this constitution, production cost can also be reduced.

It is to be noted that in the mode in which the storage chamber 3 of the above-described embodiment is used as the heating chamber for heating the articles, the electric heater 80 disposed in the storage chamber 3 may be operated to supplementarily perform the heating by the electric heater 80 in addition to the heating by the radiator 14. In this case, it is possible to avoid, in advance, a disadvantage that the storage chamber 3 cannot be sufficiently heated by shortage of the heating capability caused at low outside air temperature, for example, in winter. Since the electric heater 80 supplements the heating by the radiator 14, the capacity of the electric heater 80 can be reduced, and therefore the power consumption can be reduced as compared with the heating only by the electric heater.

Moreover, in the present embodiment, one storage chamber usable in such a manner as to be switched to be hot/cold is disposed, but the present invention is not limited to this. Two or more storage chambers, a radiator and an evaporator for heating/cooling each storage chamber, and channel control means for controlling refrigerant circulation may be disposed, and the channel control means may be controlled in such a manner as to switch the heating/cooling of each storage chamber.

Furthermore, in the present embodiment, the radiator 14 and the evaporator 18 are disposed in the storage chamber 3, but the present invention is not limited to the embodiment. For example, a duct may be disposed outside the storage chamber, the radiator and evaporator are disposed in the duct, air blowing is switched by the air blower to thereby send hot or cold air to the storage chambers, and accordingly the heating/cooling is switched. Even in this case, the present invention is effective.

It is to be noted that in the present embodiment, the internal intermediate pressure type two-stage compression system rotary compressor is used, but the compressor usable in the present invention is not limited to this compressor, and any compression form or stage number may be used.

(Embodiment 2)

Figure 4:
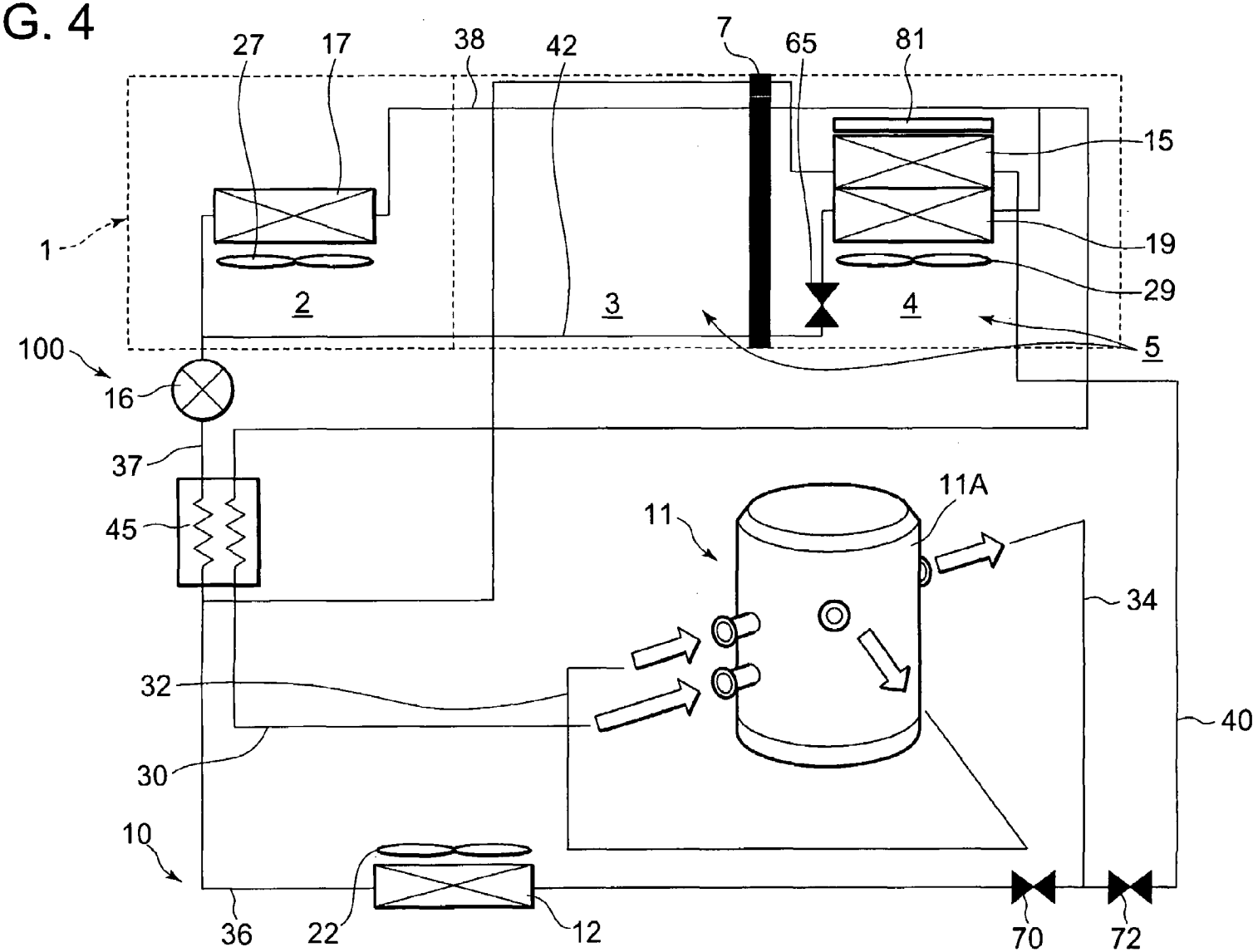
FIG. 4 is a refrigerant circuit diagram of the heating/cooling system according to another embodiment of the present invention (Embodiment 2)

Next, FIG. 4 is a schematic constitution diagram of a heating/cooling system 100 to which another invention has been applied. It is to be noted that this heating/cooling system of the present invention is also usable in a showcase, an automatic vending machine, an air conditioner, a cold/hot storage or the like.

In FIG. 4, reference numeral 1 denotes a storage chamber of the heating/cooling system 100, and the storage chamber 1 is surrounded with an insulating member. A cooling chamber 2 and a storage chamber 5are disposed in the storage chamber 1, and the storage chamber 5 can be divided by an insulating material 7 which is a partition member in an insulating manner.

The insulating material 7 is a partition member capable of dividing the storage chamber 5 in an insulating manner, and is structured to be movable. Moreover, when the storage chamber 5 is divided by the insulating material 7 as shown in FIG. 4, a chamber 3 is formed in one storage chamber 5 divided by the insulating material 7, and a chamber 4 is formed in the other storage chamber 5 (on the right side of the insulating material 7 in FIG. 4). In this case, the cooling chamber 2 is connected to the chamber 3. That is, when the cooling chamber 2 and the chamber 3 are not divided by the insulating material 7 as described later, the cooling chamber 2 is not partitioned from the chamber 3 in the insulating manner, and the chamber 3 is formed in such a manner as to communicate with the cooling chamber 2. Accordingly, cold air cooled in an evaporator 17 by a fan 27 disposed in the cooling chamber 2 as described later is supplied to the chamber 3, and the chamber is cooled in the same manner as in the cooling chamber 2.

Figure 7:
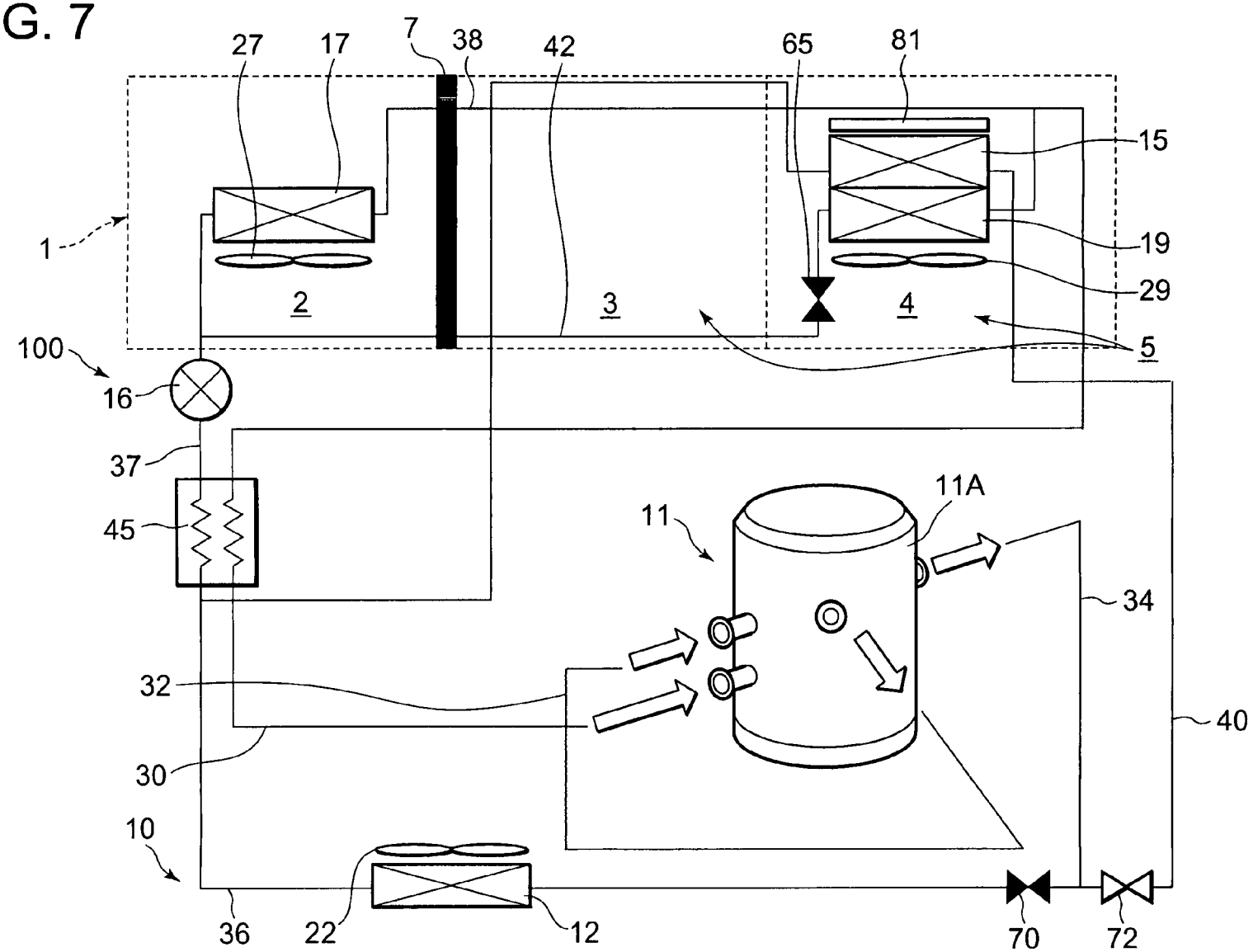
FIG. 7 is a refrigerant circuit diagram showing a flow of refrigerant in a mode in which the chambers 3 and 4 of FIG. 4 are used as heating chambers.

On the other hand, in a case where the storage chamber 5 is not divided by the insulating material 7, and the cooling chamber 2 is divided from the storage chamber 5 as shown in FIG. 7, air heated in radiator 15 by a fan 29 described later, or air cooled by an evaporator 19 is supplied into the storage chamber 5. Therefore, all spaces (chambers 3 and 4) in the storage chamber 5 can be heated or cooled by the radiator 15 or the evaporator 19.

In the cooling chamber 2, the evaporator 17 for evaporating refrigerant, and the fan 27 for sending (circulating) air which has exchanged heat with the evaporator 17 to the cooling chamber 2 are disposed. It is to be noted that the evaporator 17 is disposed separately from the evaporator 19 described later.

Moreover, in a case where the storage chamber 5 is divided by the insulating material 7, in the chamber 4 on the side which does not communicate with the cooling chamber 2, the radiator 15 for heating the inside of the chamber 4, an electric heater 81 which is an auxiliary heater for heating the chamber 4, the evaporator 19 for cooling the inside of the chamber 4, and the fan 29 for sending (circulating) air which has exchanged heat with the radiator 15 or the evaporator 19, or air heated by the electric heater 81 into the chamber 4 are disposed.

On the other hand, in FIG. 4, reference numeral 10 denotes a refrigerant circuit, and a compressor 11, a gas cooler 12, an expansion valve 16 which is a pressure reducing device, the evaporator 17 and the like are successively piped/connected in an annular shape to thereby constitute the circuit.

That is, a refrigerant discharge tube 34 of the compressor 11 is connected to an inlet of the gas cooler 12. Here, the compressor 11 of the present embodiment is an internal intermediate pressure type two-step compression system rotary compressor, and has a driving element (not shown), and first and second rotary compression elements (not shown) driven by this driving element in a sealed container 11A.

In the figure, reference numeral 30 denotes a refrigerant introducing tube for introducing the refrigerant to the first rotary compression element of the compressor 11, and one end of the refrigerant introducing tube 30 communicates with a cylinder of the first rotary compression element. The other end of the refrigerant introducing tube 30 is connected to an outlet of an internal heat exchanger 45 described later.

In the figure, reference numeral 32 denotes a refrigerant introducing tube for introducing the refrigerant compressed by the first rotary compression element to the second rotary compression element. The refrigerant discharge tube 34 is a refrigerant pipe for discharging the refrigerant compressed by the second rotary compression element to the gas cooler 12.

A refrigerant pipe 36 connected to the outlet side of the gas cooler 12 is connected to the internal heat exchanger 45. It is to be noted that the internal heat exchanger 45 exchanges heat between the refrigerant on a high-pressure side, and the refrigerant on a low-pressure side. A refrigerant pipe 37 connected to the outlet of the internal heat exchanger 45 is connected to an inlet of the evaporator 17 of the cooling chamber 2 via the expansion valve 16.

Here, a first bypass circuit 40 is branched midway in the refrigerant discharge tube 34. The first bypass circuit 40 is disposed in such a manner as to extend through the radiator 15 disposed in the storage chamber 4, and is connected to the refrigerant pipe 36. Moreover, the first bypass circuit 40 and the refrigerant discharge tube 34 are provided with electromagnetic valves 70, 72 which are channel control means for controlling refrigerant circulation with respect to the gas cooler 12 and the radiator 15. It is to be noted that the refrigerant circulation into the gas cooler 12 and radiator 15 is not limited to control of the respective electromagnetic valves 70 and 72, and the refrigerant circulation into the gas cooler 12 and radiator 15 may be controlled using and switching a three-way valve.

Moreover, a second bypass circuit 42 is branched from a middle portion of the refrigerant pipe 37 extending from the expansion valve 16. The second bypass circuit 42 is disposed in such a manner as to pass through the evaporator 19 disposed in the chamber 4, and thereafter extend together with a refrigerant pipe 38 extending from the evaporator 17. In a piping on the inlet side of the evaporator 19, an electromagnetic valve 65 is disposed as the channel control means for controlling the refrigerant circulation into the evaporator 19.

Here, as the refrigerant to be sealed in the refrigerant circuit 10, carbon dioxide ($CO_2$) which is ecological for global environment and which is natural refrigerant is used in consideration of combustibility, toxicity and the like.

Moreover, the above-described respective electromagnetic valves 65, 70, 72 are controlled in such a manner as to open/close by control devices (not shown), respectively. It is to be noted that the control device is control means for controlling the heating/cooling system 100, and in addition to the respective electromagnetic valves 65, 70, 72, operations of the compressor 11 and fans 22, 27, 29 and the like are also controlled.

(1) Mode to Use Chambers 3 and 4 as Cooling Chambers

Figure 5:
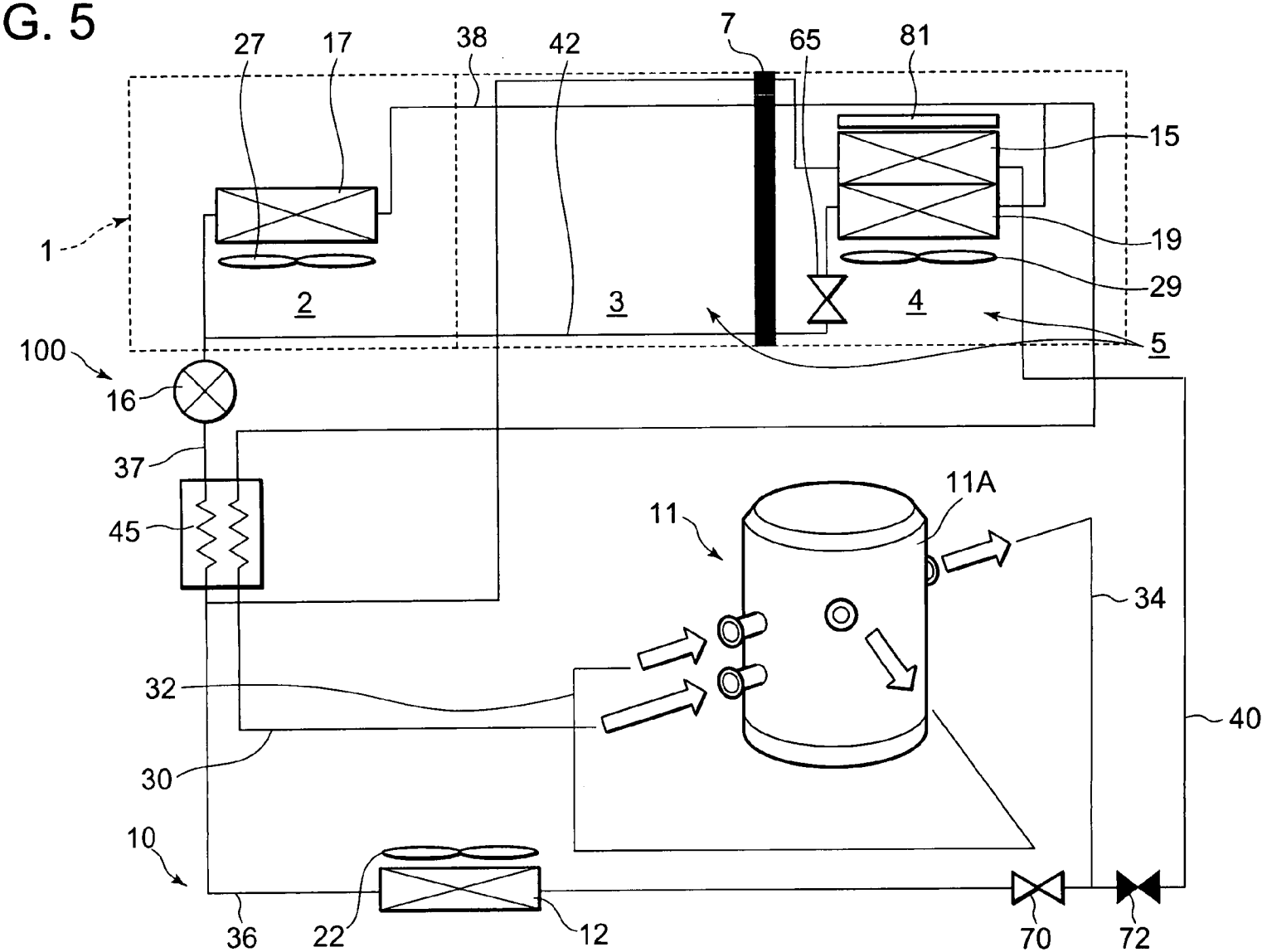
FIG. 5 is a refrigerant circuit diagram showing a flow of refrigerant in a mode in which chambers 3 and 4 of FIG. 4 are used as cooling chambers.

Next, an operation of the heating/cooling system 100 constituted as described above according to the present invention will be described. First, a mode to use the chambers 3 and 4 as the cooling chambers for cooling articles will be described with reference to FIG. 5. FIG. 5 is a refrigerant circuit diagram showing a flow of the refrigerant in this mode. When an operator attaches the insulating material 7 to the storage chamber 5, the inside of the storage chamber 5 is divided, the chamber 4 is formed on the right side of the insulating material 7, and the chamber 3 is formed on the left side. In this case, the chamber 3 is structured in such a manner as to communicate with the cooling chamber 2 as described above.

Moreover, the electromagnetic valve 70 is opened, the electromagnetic valve 72 is closed, and the first bypass circuit 40 is blocked by the control device (not shown). Accordingly, all the refrigerant discharged from the compressor 11 flows through the gas cooler 12 from the refrigerant discharge tube 34. The control device opens the electromagnetic valve 65 to open the second bypass circuit 42. Accordingly, the refrigerant from the expansion valve 16 flows into the evaporator 19. It is to be noted that in FIGS. 5 to 7 described hereinafter, a white electromagnetic valve indicates a state in which the valve is opened by the control device, and a black electromagnetic valve indicates a state in which the valve is closed by the control device.

Moreover, the control device starts the operations of the fans 22, 27, 29, and drives the driving element of the compressor 11. Accordingly, the low-pressure refrigerant is sucked and compressed by the first rotary compression element of the compressor 11 to indicate an intermediate pressure, and is discharged into the sealed container 11A.

The refrigerant discharged into the sealed container 11A is once discharged to the outside of the sealed container 11A from the refrigerant introducing tube 32, and is thereafter sucked and compressed in the second rotary compression element. Moreover, the refrigerant forms a high-temperature/pressure refrigerant gas, and is discharged to the outside of the compressor 11 from the refrigerant discharge tube 34. At this time, the refrigerant is compressed to an optimum supercritical pressure.

The refrigerant gas discharged from the compressor 11 flows into the gas cooler 12 from the refrigerant discharge tube 34, because the electromagnetic valve 70 is opened, and the electromagnetic valve 72 is closed. Here, the high-temperature/pressure refrigerant compressed by the compressor 11 does not condense, and operation is performed in a supercritical state. After the high-temperature/pressure refrigerant gas radiates heat in the gas cooler 12, the gas passes through the internal heat exchanger 45. The heat of the refrigerant is taken by the refrigerant flowing out of the evaporators 17, 19 on the low-pressure side, and the refrigerant is further cooled. By the presence of the internal heat exchanger 45, the heat of the refrigerant flowing out of the gas cooler 12 and passing through the internal heat exchanger 45 is taken by the refrigerant on the low-pressure side, and therefore supercooling degree of the refrigerant increases the more. Therefore, the cooling capabilities in the respective evaporators 17, 19 are enhanced.

The refrigerant gas cooled by the internal heat exchanger 45 on the high-pressure side reaches the expansion valve 16. It is to be noted that the refrigerant gas still has a supercritical state in the inlet of the expansion valve 16. The refrigerant is brought into a two-phase mixed state of a gas/liquid by pressure drop in the expansion valve 16. Moreover, the refrigerant brought into the two-phase mixed state flows into the evaporator 17 disposed in the cooling chamber 2. There, the refrigerant evaporates, and absorbs the heat from ambient air to thereby exert a cooling function. It is to be noted that the air cooled by the evaporation of the refrigerant in the evaporator 17 is circulated through the cooling chamber 2 and the chamber 3 communicating with the cooling chamber 2 by the operation of the fan 27 to thereby cool the insides of the cooling chamber 2 and the chamber 3.

On the other hand, the electromagnetic valve 65 is opened as described above, and therefore a part of the refrigerant whose pressure has been reduced by the expansion valve 16 enters the second bypass circuit 42 branched/connected to the middle portion of the refrigerant pipe 37. The refrigerant then flows in the evaporator 19 installed in the chamber 4, evaporates there, and absorbs the heat from the ambient air to thereby exert a cooling function. The air cooled by the evaporation of the refrigerant in the evaporator 19 is circulated in the chamber 4 by the operation of the fan 29 to thereby cool the chamber 4.

Moreover, the refrigerant which has flown out of the evaporator 19 flows together with the refrigerant flowing in the refrigerant pipe 38 from the evaporator 17, and reaches the internal heat exchanger 45. There, the refrigerant takes the heat from the refrigerant on the high-pressure side, and is subjected to a heating function. Here, the refrigerant evaporates in the respective evaporators 17, 19 at the low temperature. The refrigerant which has flown out of the respective evaporators 17, 19 does not have a complete gas state, and the liquid is sometimes mixed. However, when the refrigerant is passed through the internal heat exchanger 45, and allowed to exchange the heat with the high-temperature refrigerant on the high-pressure side. Accordingly, the refrigerant is superheated, the superheating degree of the refrigerant is secured at this time, and the refrigerant completely turns to the gas.

Accordingly, the refrigerant which has flown out of the respective evaporators 17, 19 can be securely gasified. Therefore, without disposing any accumulator or the like on the low-pressure side, suction of liquid refrigerant into the compressor 11, that is, liquid backflow is securely prevented. A disadvantage that the compressor 11 is damaged by liquid compression can be avoided. Therefore, reliability of the heating/cooling system 100 can be enhanced.

It is to be noted that the refrigerant which has been heated by the internal heat exchanger 45 repeats a cycle to be sucked into the first rotary compression element of the compressor 11 from the refrigerant introducing tube 30.

Thus, the storage chamber 5 is comparted by the insulating material 7, and the accordingly formed chamber 3 is structured in such a manner as to communicate with the cooling chamber 2, so that the inside of the chamber 3 can be cooled by the evaporator 17 disposed in the cooling chamber 2. Moreover, the gas cooler 12 is disposed separately from the radiator 15 for heating the chamber 4, the heat is radiated from the refrigerant in the gas cooler 12, and accordingly the chamber 4 is usable as the cooling chamber for cooling the articles. Therefore, the chambers 3 and 4 can be cooled.

Figure 6:
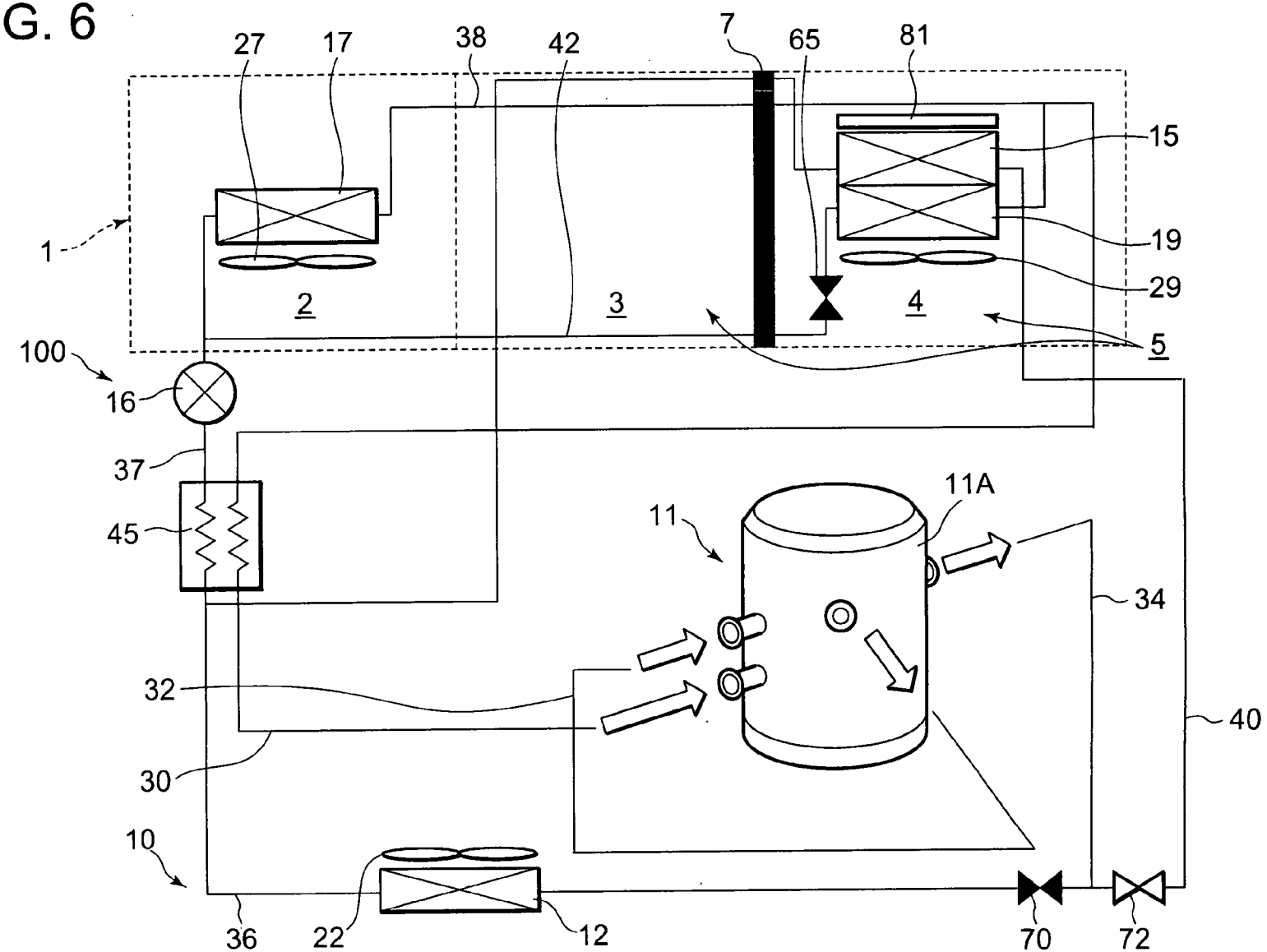
FIG. 6 is a refrigerant circuit diagram showing a flow of refrigerant in a mode in which the chamber 3 of FIG. 4 is used as the cooling chamber, and the chamber 4 is used as a heating chamber.

(2) Mode in Which Chamber 3 is Used as Cooling Chamber and Chamber 4 is Used as Heating Chamber Next, a mode in which the chamber 3 is used as the cooling chamber for cooling the articles, and the chamber 4 is used as the heating chamber for heating the articles will be described with reference to FIG. 6. FIG. 6 is a refrigerant circuit diagram showing a flow of refrigerant in this mode.

It is assumed that in this mode, the storage chamber 5 is comparted by the insulating material 7 in the same manner as in the above-described mode. Therefore, as described above, the chamber 3 is structured in such a manner as to communicate with the cooling chamber 2. The electromagnetic valve 70 is closed by the control device (not shown), and the electromagnetic valve 72 is opened to thereby open the first bypass circuit 40. Accordingly, the refrigerant discharged from the compressor 11 does not flow in the gas cooler 12, and all flows in the first bypass circuit 40 from the middle portion of the refrigerant discharge tube 34.

Moreover, the control device closes the electromagnetic valve 65, and blocks the second bypass circuit 42. Accordingly, all the refrigerant from the expansion valve 16 flows in the evaporator 17. Furthermore, the control device starts the operations of the fans 22, 27, 29, and drives the driving element of the compressor 11. Accordingly, the low-pressure refrigerant is sucked into the first rotary compression element of the compressor 11, compressed to indicate an intermediate pressure, and discharged into the sealed container 11A. The refrigerant discharged into the sealed container 11A is once discharged to the outside of the sealed container 11A from the refrigerant introducing tube 32, and is thereafter sucked and compressed by the second rotary compression element. Moreover, the refrigerant turns to the high-temperature/pressure refrigerant gas, and is discharged to the outside of the compressor 11 from the refrigerant discharge tube 34. At this time, the refrigerant is compressed to optimum supercritical pressure.

Since the electromagnetic valve 70 is closed, and the electromagnetic valve 72 is opened as described above, the refrigerant gas discharged from the compressor 11 enters the first bypass circuit 40 from the refrigerant discharge tube 34, and flows in the radiator 15 disposed in the chamber 4. Here, the high-temperature/pressure refrigerant compressed by the compressor 11 does not condense, and is operated in a supercritical state. Moreover, the high-temperature/pressure refrigerant gas radiates the heat in the radiator 15. It is to be noted that the air heated by the heat radiation of the refrigerant in the radiator 15 is circulated in the chamber 4 by the operation of the fan 29 to thereby heat the inside of the chamber 4. In the present invention, since carbon dioxide is used as the refrigerant, the refrigerant does not condense in the radiator 15, therefore a heat exchange capability in the radiator 15 is remarkably high, and the air in the chamber 4 can be sufficiently set at the high temperature.

Thereafter, the refrigerant enters the refrigerant pipe 36 from the first bypass circuit 40, and passes through the internal heat exchanger 45. The heat of the refrigerant is taken by the refrigerant which has flown out of the evaporator 17 on the low-pressure side, and is further cooled. Moreover, the refrigerant gas on the high-pressure side cooled by the internal heat exchanger 45 reaches the expansion valve 16. It is to be noted that the refrigerant gas still has the supercritical state in the inlet of the expansion valve 16. The refrigerant is brought into a mixed state of two phases of gas/liquid by the pressure drop in the expansion valve 16, and flows in the evaporator 17 disposed in the cooling chamber 2.

There, the refrigerant evaporates, and absorbs heat from the ambient air to thereby exert the cooling function. It is to be noted that the air cooled by the evaporation of the refrigerant in the evaporator 17 is circulated in the cooling chamber 2 and the chamber 3 communicating with the cooling chamber 2 to thereby cool the insides of the cooling chamber 2 and chamber 3 by the operation of the fan 27. Moreover, the refrigerant flows out of the evaporator 17, enters the refrigerant pipe 38, and passes through the internal heat exchanger 45.

There, the refrigerant repeats a cycle of taking the heat from the refrigerant on the high-pressure side, receiving the heating function, and completely turning into the gas state to be sucked into the first rotary compression element of the compressor 11 from the refrigerant introducing tube 30.

Thus, the storage chamber 5 is comparted by the insulating material 7, and the accordingly formed one chamber (chamber 3) is structured in such a manner as to communicate with the cooling chamber 2, so that the chamber can be cooled by the evaporator 17 disposed in the cooling chamber 2, and the other chamber (chamber 4) can be heated by the radiator 15.

(3) Mode to Use Chambers 3 and 4 as Heating Chambers

Next, an operation of the heating/cooling system 100 in a mode in which the chambers 3 and 4 are used as heating chambers for heating articles will be described with reference to FIG. 7. FIG. 7 is a refrigerant circuit diagram showing a flow of the refrigerant in this mode.

The operator removes the insulating material 7 for comparting the storage chamber 5, and attaches the insulating material 7 between the cooling chamber 2 and the storage chamber 5. Accordingly, the cooling chamber 2 is comparted from the storage chamber 5 in an insulating manner. The chambers 3 and 4 are connected to thereby constitute one storage chamber 5.

Moreover, the electromagnetic valve 70 is closed, the electromagnetic valve 72 is opened, and the first bypass circuit 40 is released by the control device (not shown). Accordingly, all the refrigerant discharged from the compressor 11 does not flow through the gas cooler 12, and flows in the first bypass circuit 40 from the middle portion of the refrigerant discharge tube 34.

Moreover, the control device closes the electromagnetic valve 65 to block the second bypass circuit 42. Accordingly, the refrigerant from the expansion valve 16 flows into the evaporator 17. The control device starts the operations of the fans 22, 27, 29, and drives the driving element of the compressor 11. Accordingly, the low-pressure refrigerant is sucked and compressed by the first rotary compression element of the compressor 11 to indicate an intermediate pressure, and is discharged into the sealed container 11A. The refrigerant discharged into the sealed container 11A is once discharged to the outside of the sealed container 11A from the refrigerant introducing tube 32, and is thereafter sucked and compressed in the second rotary compression element. Moreover, the refrigerant forms a high-temperature/pressure refrigerant gas, and is discharged to the outside of the compressor 11 from the refrigerant discharge tube 34. At this time, the refrigerant is compressed to an optimum supercritical pressure.

The refrigerant gas discharged from the compressor 11 flows into the first bypass circuit 40 from the refrigerant discharge tube 34, because the electromagnetic valve 70 is closed, and the electromagnetic valve 72 is opened as described above. Here, the high-temperature/pressure refrigerant compressed by the compressor 11 does not condense, and operation is performed in a supercritical state. Moreover, the high-temperature/pressure refrigerant gas radiates heat in the radiator 15. It is to be noted that the air heated by the heat radiation of the refrigerant in the radiator 15 is circulated in the storage chamber 5 to heat all the spaces in the storage chamber 5 by the operation of the fan 29. Since carbon dioxide is used as the refrigerant in the present invention, the refrigerant does not condense in the radiator 15, therefore a heat exchange capability in the radiator 15 is remarkably high, and the air in the storage chamber 5 can be sufficiently set at high temperature.

Thereafter, the refrigerant enters the refrigerant pipe 36 from the first bypass circuit 40, and passes through the internal heat exchanger 45. The heat of the refrigerant is taken by the refrigerant flowing out of the evaporator 17 on the low-pressure side, and the refrigerant is further cooled. Moreover, the refrigerant gas cooled by the internal heat exchanger 45 on the high-pressure side reaches the expansion valve 16. It is to be noted that the refrigerant gas still has a supercritical state in the inlet of the expansion valve 16. The refrigerant is brought into a two-phase mixed state of a gas/liquid by pressure drop in the expansion valve 16, and flows into the evaporator 17 disposed in the cooling chamber 2.

There, the refrigerant evaporates, and absorbs the heat from ambient air to thereby exert a cooling function. It is to be noted that the air cooled by the evaporation of the refrigerant in the evaporator 17 is circulated through the cooling chamber 2 by the operation of the fan 27 to thereby cool the inside of the cooling chamber 2. Moreover, the refrigerant flows out of the evaporator 17, enters the refrigerant pipe 38, and passes through the internal heat exchanger 45.

There, the refrigerant repeats a cycle of taking the heat from the refrigerant on the high-pressure side, receiving the heating function, and completely turning into the gas state to be sucked into the first rotary compression element of the compressor 11 from the refrigerant introducing tube 30.

Thus, the cooling chamber 2 is partitioned off the storage chamber 5 by the insulating material 7, and all the spaces in the storage chamber 5 can be heated by the radiator 15.

As described above in detail, when carbon dioxide having a satisfactory heating characteristic is used as the refrigerant, the inside of the storage chamber 5 can be heated by the radiator 15, and cooled by the evaporator 19. Accordingly, the storage chamber 5 can be heated by the refrigerant circuit 10 without disposing any heating member such as an electric heater or any special heating device. Accordingly, power consumption of the heating/cooling system 100 can be remarkably reduced.

Moreover, when the refrigerant circulation is controlled by the respective electromagnetic valves 65, 70, 72 as in the above-described respective modes, the storage chamber 5 is usable in such a manner as to be switched to be hot/cold. Therefore, when the opening/closing of each electromagnetic valve is switched depending on a use situation, the storage chamber 5 can be freely controlled to be hot/cold.

Furthermore, as in the above-described respective modes, the storage chamber 5 can be comparted into the chambers 3 and 4, or the cooling chamber 2 is partitioned off the storage chamber 5 by the insulating material 7. That is, since a ratio of a heating region heated by the radiator 14 to a cooling region cooled by the evaporator 19 can be changed by the insulating material 7, convenience of the heating/cooling system 100 can be enhanced.

Additionally, when the insulating material 7 is attached to the storage chamber 5, the chamber 3 communicates with the cooling chamber 2, and the chamber is cooled by the evaporator 17. When the insulating material 7 is attached between the cooling chamber 2 and the storage chamber 5, the chamber is heated or cooled by the radiator 15 or the evaporator 19. Therefore, when the insulating material 7 is simply moved without disposing any radiator or evaporator in the chamber 3, the heating/cooling can be freely switched. Accordingly, production cost of the heating/cooling system 100 can be reduced.

(Embodiment 3)

Figure 8:
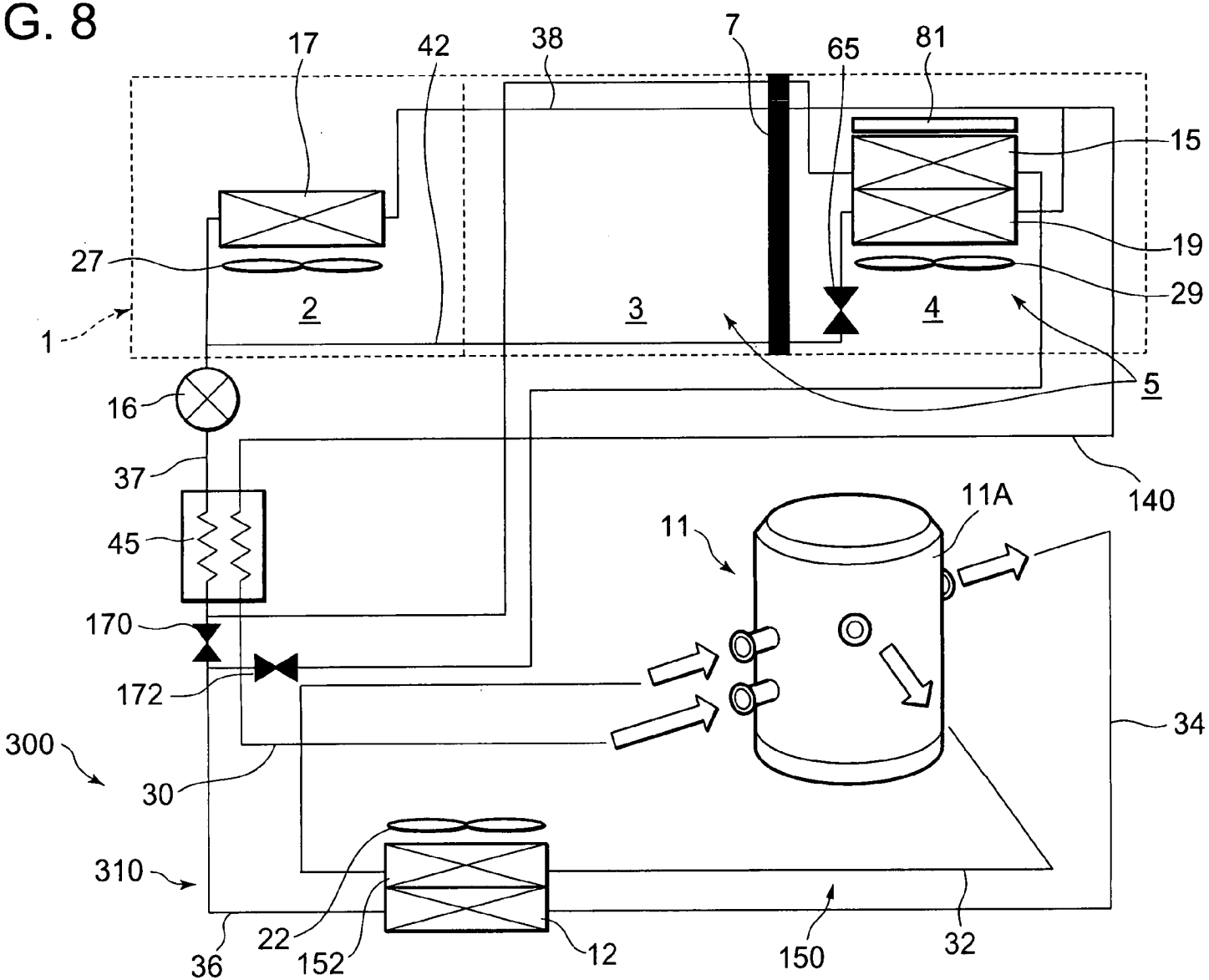
FIG. 8 is a refrigerant circuit diagram of a heating/cooling system according to another embodiment of the present invention (Embodiment 3)

Next, another embodiment of a heating/cooling system of the present invention will be described with reference to FIGS. 8 to 11. FIG. 8 is a schematic constitution diagram of a heating/cooling system 300 in the present embodiment. It is to be noted that components denoted with the same reference numerals as those of FIGS. 4 to 7 produce similar effects.

In FIG. 8, reference numeral 310 denotes a refrigerant circuit of the present embodiment, and a compressor 11, a gas cooler 12, an expansion valve 16 which is a pressure reducing device, an evaporator 17 and the like are successively piped/connected in an annular shape to thereby constitute the circuit.

In the figure, reference numeral 150 denotes an intermediate cooling circuit comprising a heat exchanger 152 for cooling the refrigerant compressed by a first rotary compression element of the compressor 11, and thereafter allowing a second rotary compression element to suck the refrigerant. The heat exchanger 152 is formed integrally with the gas cooler 12, and a fan 22 for passing air through the heat exchanger 152 and the gas cooler 12 to radiate heat from the refrigerant is disposed in the vicinity of the heat exchanger 152 and the gas cooler 12.

Moreover, in the figure, reference numeral 140 denotes a first bypass circuit branched from a middle portion of a refrigerant pipe 36 connected to an outlet of the gas cooler 12, and this first bypass circuit 140 is disposed in such a manner as to extend through a radiator 15 disposed in a chamber 4, and connected to the refrigerant pipe 36 on the outlet side of an electromagnetic valve 170 described later.

The electromagnetic valve 170 and another electromagnetic valve 172 are disposed as channel control means for controlling refrigerant circulation into the radiator 15 in a piping on a downstream side of a branch of the first bypass circuit 140 of the refrigerant pipe 36, and on the inlet side of the radiator 15 of the first bypass circuit 140. The electromagnetic valves 170 and 172 are controlled in such a manner as to open/close by a control device (not shown).

That is, the electromagnetic valve 170 is opened, the electromagnetic valve 172 is closed, and the first bypass circuit 140 is blocked by the control device (not shown). Accordingly, the refrigerant which has radiated the heat in the gas cooler 12 does not flow into the first bypass circuit 140, and flows into an internal heat exchanger 45 as such. On the other hand, when the control device closes the electromagnetic valve 170, opens the electromagnetic valve 172, and releases the first bypass circuit 140, the refrigerant that has radiated the heat in the gas cooler 12 flows into the radiator 15 from the first bypass circuit 140.

(1) Mode to Use Chambers 3 and 4 as Cooling Chambers

Figure 9:
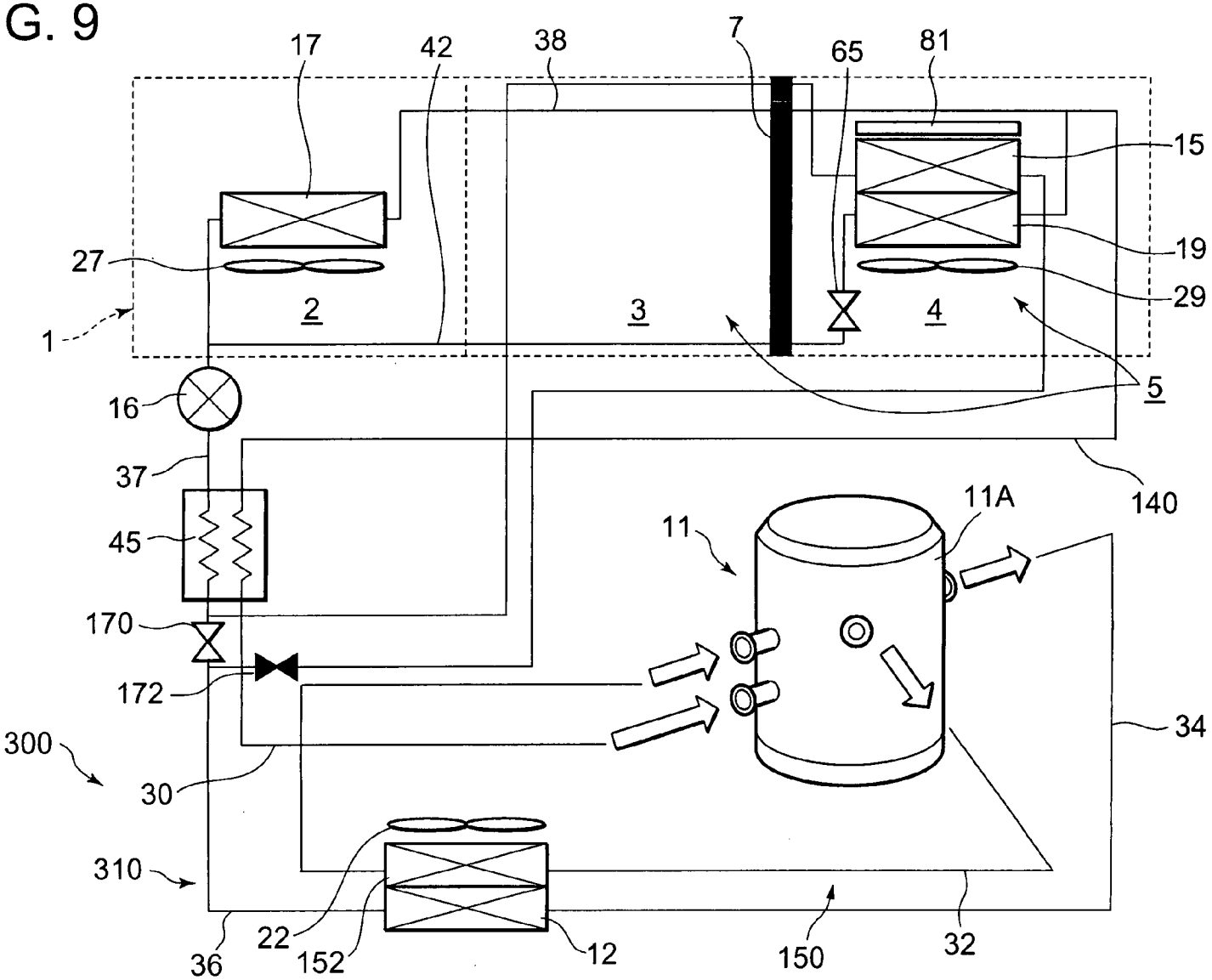
FIG. 9 is a refrigerant circuit diagram showing a flow of refrigerant in a mode in which the chambers 3 and 4 of the heating/cooling system of FIG. 8 are used as the cooling chambers.

Next, an operation of the heating/cooling system 300 constituted as described above according to the present invention will be described. First, a mode to use the chambers 3 and 4 as the cooling chambers for cooling articles will be described with reference to FIG. 9. FIG. 9 is a refrigerant circuit diagram showing a flow of the refrigerant in this mode. When an operator attaches the insulating material 7 to the storage chamber 5, the inside of the storage chamber 5 is comparted, the chamber 4 is formed on the right side of the insulating material 7, and the chamber 3 is formed on the left side. In this case, the chamber 3 is structured in such a manner as to communicate with the cooling chamber 2 as described above.

Moreover, the electromagnetic valve 70 is opened, the electromagnetic valve 72 is closed, and the first bypass circuit 40 is blocked by the control device (not shown). Accordingly, the refrigerant from the gas cooler 12 does not flow in the first bypass circuit 140, and flows through the internal heat exchanger 45 as such. The control device opens the electromagnetic valve 65 to open the second bypass circuit 42. Accordingly, the refrigerant from the expansion valve 16 flows into the evaporator 19. It is to be noted that in FIGS. 9 to 11 described hereinafter, a white electromagnetic valve indicates a state in which the valve is opened by the control device, and a black electromagnetic valve indicates a state in which the valve is closed by the control device.

Moreover, the control device starts the operations of the fans 22, 27, 29, and drives the driving element of the compressor 11. Accordingly, the low-pressure refrigerant gas is sucked and compressed by the first rotary compression element (not shown) of the compressor 11 from the refrigerant introducing tube 30 to indicate an intermediate pressure, and is discharged into the sealed container 11A. The refrigerant discharged into the sealed container 11A is once discharged to the outside of the sealed container 11A from the refrigerant introducing tube 32, and thereafter enters the intermediate cooling circuit 150, and passes through the heat exchanger 152. There, the refrigerant radiates heat by the air passing by the fan 22.

Thus, the refrigerant compressed by the first rotary compression element is cooled by the heat exchanger 152, and thereafter sucked into the second rotary compression element, so that the temperature of the refrigerant gas discharged from the second rotary compression element of the compressor 11 can be lowered. Accordingly, since evaporation temperature of the refrigerant in the respective evaporators 17, 19 drop, the cooling chamber 2 and the respective chambers 3, 4 can be cooled at lower temperature. Therefore, cooling capabilities of the cooling chamber 2, and the chambers 3, 4 by the respective evaporators 17, 19 can be enhanced.

Thereafter, the refrigerant is sucked and compressed by the second rotary compression element to form a high-temperature/pressure refrigerant gas, and the gas is discharged to the outside of the compressor 11 from the refrigerant discharge tube 34. At this time, the refrigerant is compressed to the appropriate supercritical pressure. The refrigerant gas discharged from the compressor 11 flows in the gas cooler 12. Here, the refrigerant does not condense, and radiates the heat as such in the supercritical state.

Moreover, the refrigerant which has radiated the heat in the gas cooler 12 passes through the intermediate cooling circuit 150 as such. There, the heat of the refrigerant is taken by the refrigerant which has flown out of the evaporators 17, 19 on the low-pressure side, and is further cooled. By the presence of the internal heat exchanger 45, the heat of the refrigerant which has flown out of the gas cooler 12 and passed through the internal heat exchanger 45 is taken by the refrigerant on the low-pressure side, and therefore supercooling degree of the refrigerant increases. Therefore, the cooling capabilities in the evaporators 17, 19 are enhanced.

The refrigerant gas cooled by the internal heat exchanger 45 on the high-pressure side reaches the expansion valve 16. It is to be noted that the refrigerant gas still has a supercritical state in the inlet of the expansion valve 16. The refrigerant is brought into a two-phase mixed state of a gas/liquid by pressure drop in the expansion valve 16. Moreover, the refrigerant brought into the two-phase mixed state flows into the evaporator 17 disposed in the cooling chamber 2. There, the refrigerant evaporates, and absorbs the heat from ambient air to thereby exert a cooling function. It is to be noted that the air cooled by the evaporation of the refrigerant in the evaporator 17 is circulated through the cooling chamber 2 and the chamber 3 communicating with the cooling chamber 2 by the operation of the fan 27 to thereby cool the insides of the cooling chamber 2 and the chamber 3.

Moreover, by an effect to cool the refrigerant compressed by the first rotary compression element by the heat exchanger 152 as described above, and an effect to pass the refrigerant discharged from the gas cooler 12 on the high-pressure side through the internal heat exchanger 45 to cool the refrigerant, the refrigerant evaporates at lower temperature by the evaporator 17. Accordingly, the cooling chamber 2 and the chamber 3 can be cooled at lower temperature, and the cooling capability can be enhanced. Moreover, the refrigerant which has evaporated in the evaporator 17 thereafter flows out of the evaporator 17, and enters the refrigerant pipe 38.

On the other hand, the electromagnetic valve 65 is opened as described above, and therefore a part of the refrigerant whose pressure has been reduced by the expansion valve 16 flows in the evaporator 19 installed in the storage chamber 4 from the second bypass circuit 42. Therefore, the refrigerant evaporates, and absorbs the heat from the ambient air to thereby exert a cooling function. The air cooled by the evaporation of the refrigerant in the evaporator 19 is circulated in the chamber 4 by the operation of the fan 29 to thereby cool the chamber 4.

Moreover, as described above, by the effect to cool the refrigerant compressed by the first rotary compression element by the heat exchanger 152, and the effect to pass the refrigerant discharged from the gas cooler 12 on the high-pressure side through the internal heat exchanger 50 to cool the refrigerant, the refrigerant evaporates at lower temperature in the evaporator 19. Accordingly, the inside of the chamber 4 can be cooled at lower temperature, and the cooling capability can be enhanced.

Moreover, the refrigerant which has flown out of the evaporator 19 flows together with the refrigerant flowing in the refrigerant pipe 38 from the evaporator 17, and reaches the internal heat exchanger 45.

There, the refrigerant takes the heat from the refrigerant on the high-pressure side, and is subjected to a heating function. Here, the refrigerant evaporates in the respective evaporators 17, 19 at the low temperature. The refrigerant which has flown out of the respective evaporators 17, 19 does not have a complete gas state, and the liquid is sometimes mixed. However, when the refrigerant is passed through the internal heat exchanger 45, and allowed to exchange the heat with the high-temperature refrigerant on the high-pressure side. Accordingly, the refrigerant is superheated, the superheating degree of the refrigerant is secured at this time, and the refrigerant completely turns to the gas.

Accordingly, the refrigerant which has flown out of the respective evaporators 17, 19 can be securely gasified. Therefore, without disposing any accumulator or the like on the low-pressure side, suction of liquid refrigerant into the compressor 11, that is, liquid backflow is securely prevented. A disadvantage that the compressor 11 is damaged by liquid compression can be avoided. Therefore, reliability of the heating/cooling system 300 can be enhanced.

It is to be noted that the refrigerant which has been heated by the internal heat exchanger 45 repeats a cycle to be sucked into the first rotary compression element of the compressor 11 from the refrigerant introducing tube 30.

Thus, the inside of the storage chamber 5 is comparted by the, insulating material 7, and the accordingly formed chamber 3 is structured in such a manner as to communicate with the cooling chamber 2, so that the inside of the chamber 3 can be cooled by the evaporator 17 disposed in the cooling chamber 2. The gas cooler 12 is disposed separately from the radiator 15 for heating the chamber 4, and the heat is radiated from the refrigerant in the gas cooler 12, so that the chamber 4 can be used as a cooling chamber for cooling articles.

Figure 10:
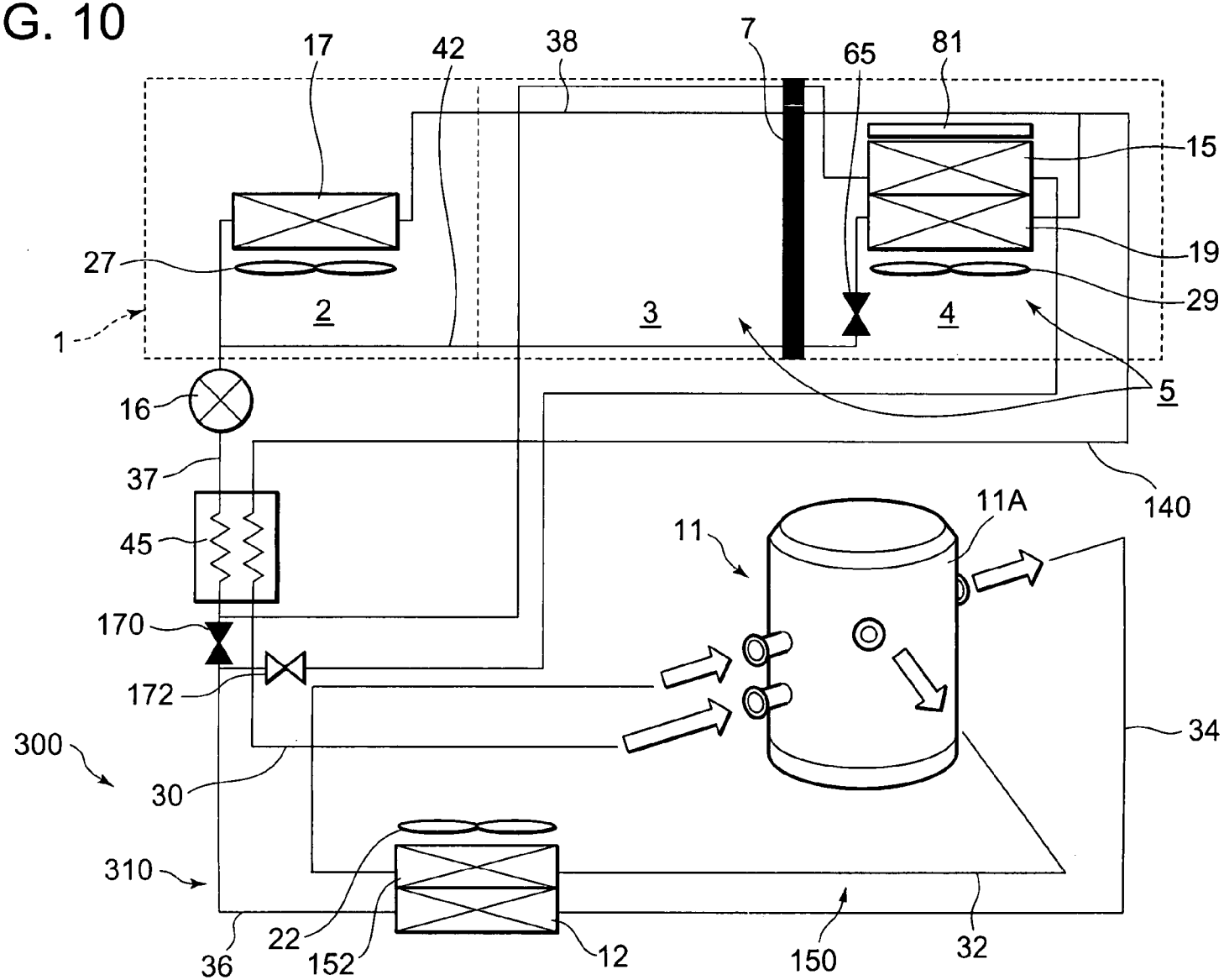
FIG. 10 is a refrigerant circuit diagram showing a flow of refrigerant in a mode in which the chamber 3 of the heating/cooling system of FIG. 8 is used as the cooling chamber, and the chamber 4 is used as the heating chamber.

(2) Mode in Which Chamber 3 is Used as Cooling Chamber and Chamber 4 is Used as Heating Chamber Next, an operation of the heating/cooling system 300 in a mode in which the chamber 3 is used as the cooling chamber for cooling the articles, and the chamber 4 is used as the heating chamber for heating the articles will be described with reference to FIG. 10. FIG. 10 is a refrigerant circuit diagram showing a flow of refrigerant in this mode.

It is assumed that in this mode, the storage chamber 5 is comparted by the insulating material 7 in the same manner as in the above-described mode. Therefore, as described above, the chamber 3 is structured in such a manner as to communicate with the cooling chamber 2. The electromagnetic valve 170 is closed by the control device (not shown), and the electromagnetic valve 172 is opened to thereby open the first bypass circuit 140. Accordingly, all the refrigerant from the gas cooler 12 flows in the first bypass circuit 140 from the middle portion of the refrigerant discharge tube 36.

Moreover, the control device closes the electromagnetic valve 65, and blocks the second bypass circuit 42. Accordingly, all the refrigerant from the expansion valve 16 flows in the evaporator 17. Furthermore, the control device starts the operations of the fans 27, 29, and drives the driving element of the compressor 11. Accordingly, the low-pressure refrigerant gas is sucked into the first rotary compression element (not shown) of the compressor 11 from the refrigerant introducing tube 30, compressed to indicate an intermediate pressure, and discharged into the sealed container 11A. The refrigerant discharged into the sealed container 11A is once discharged to the outside of the sealed container 11A from the refrigerant introducing tube 32, enters the intermediate cooling circuit 150, and passes through the heat exchanger 152. It is to be noted that since the fan 22 is not operated in the present mode, the heat radiation of the refrigerant in the heat exchanger 152 slightly or hardly occurs. Accordingly, the refrigerant sucked into the second rotary compression element can be maintained at high temperature. Therefore, the refrigerant discharged from the compressor 11 is also at high temperature, and ambient air can be heated at high temperature in the radiator 15, so that a heating capability in the radiator 15 can be secured.

Thereafter, the refrigerant is sucked and compressed by the second rotary compression element to constitute a high-temperature/pressure refrigerant gas, and discharged to the outside of the compressor 11 from the refrigerant discharge tube 34. At this time, the refrigerant is compressed to an appropriate supercritical pressure. The refrigerant gas discharged from the compressor 11 passes through the gas cooler 12. Since the fan 22 is not operated as described above, the refrigerant in the gas cooler 12 slightly or hardly radiates heat.

Since the electromagnetic valve 170 is closed, and the electromagnetic valve 172 is opened as described above, the refrigerant which has flown out of the gas cooler 12 enters the first bypass circuit 140 from the refrigerant pipe 36, and flows in the radiator 15 disposed in the chamber 4. Here, the high-temperature/pressure refrigerant compressed by the compressor 11 does not condense, and is operated in a supercritical state. Moreover, the high-temperature/pressure refrigerant gas radiates the heat in the radiator 15. It is to be noted that the air heated by the heat radiation of the refrigerant in the radiator 15 is circulated in the chamber 4 by the operation of the fan 29 to thereby heat the inside of the chamber 4. In the present invention, since carbon dioxide is used as the refrigerant, the refrigerant does not condense in the radiator 15, therefore a heat exchange capability in the radiator 15 is remarkably high, and the air in the chamber 4 can be set at the high temperature.

Moreover, since the fan 22 is not operated as described above, the refrigerant hardly radiates heat in the heat exchanger 152 and gas cooler 12 of the intermediate cooling circuit 150, and the refrigerant maintained at the high temperature can radiate the heat in the radiator 15. Accordingly, the heating capability in the radiator 15 can be sufficiently secured.

Thereafter, the refrigerant enters the refrigerant pipe 36 on the outlet side of the electromagnetic valve 170 from the first bypass circuit 140, and passes through the internal heat exchanger 45. The heat of the refrigerant is taken by the refrigerant which has flown out of the evaporator 17 on the low-pressure side, and is further cooled. Moreover, the refrigerant gas on the high-pressure side cooled by the internal heat exchanger 45 reaches the expansion valve 16. It is to be noted that the refrigerant gas still has the supercritical state in the inlet of the expansion valve 16. The refrigerant is brought into a mixed state of two phases of gas/liquid by the pressure drop in the expansion valve 16, and flows into the evaporator 17 disposed in the cooling chamber 2.

There, the refrigerant evaporates, and absorbs heat from the ambient air to thereby exert the cooling function. It is to be noted that the air cooled by the evaporation of the refrigerant in the evaporator 17 is circulated in the cooling chamber 2 and the chamber 3 communicating with the cooling chamber 2 to thereby cool the insides of the cooling chamber 2 and the chamber 3 by the operation of the fan 27. Moreover, the refrigerant flows out of the evaporator 17, enters the refrigerant pipe 38, and passes through the internal heat exchanger 45.

There, the refrigerant repeats a cycle of taking the heat from the refrigerant on the high-pressure side, receiving the heating function, and completely turning into the gas state to be sucked into the first rotary compression element of the compressor 11 from the refrigerant introducing tube 30.

Thus, the inside of the storage chamber 5 is comparted by the insulating material 7, and one chamber (chamber 3) formed by comparting the chamber by the insulating material 7 is structured in such a manner as to communicate with the cooling chamber 2, so that the chamber is cooled by the evaporator 17 disposed in the cooling chamber 2, and the other chamber (chamber 4) can be heated by the radiator 15.

(3) Mode to Use Chambers 3 and 4 as Heating Chambers

Figure 11:
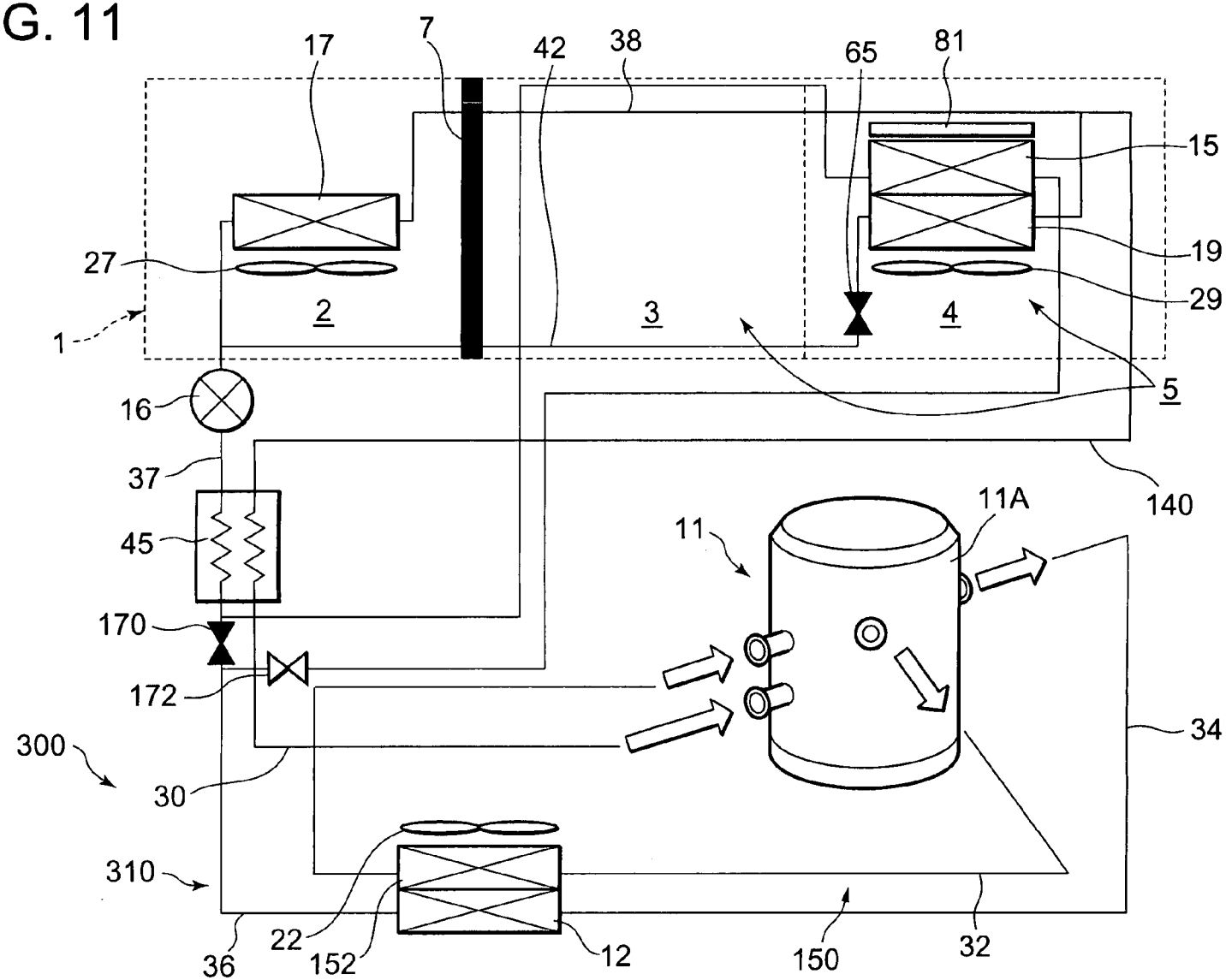
FIG. 11 is a refrigerant circuit diagram showing a flow of refrigerant in a mode in which the chambers 3 and 4 of the heating/cooling system of FIG. 8 are used as the heating chambers.

Next, an operation of the heating/cooling system 300 in a mode in which the chambers 3 and 4 are used as heating chambers for heating articles will be described with reference to FIG. 11. FIG. 11 is a refrigerant circuit diagram showing a flow of the refrigerant in this mode.

The operator removes the insulating material 7 for comparting the storage chamber 5, and attaches the insulating material 7 between the cooling chamber 2 and the storage chamber 5. Accordingly, the cooling chamber 2 is comparted from the storage chamber 5 in an insulating manner. The chambers 3 and 4 are connected to thereby constitute one storage chamber 5.

Moreover, the electromagnetic valve 170 is closed, the electromagnetic valve 172 is opened, and the first bypass circuit 140 is released by the control device (not shown). Accordingly, all the refrigerant that has flown from the gas cooler 12 flows in the first bypass circuit 140 from the middle portion of the refrigerant pipe 36.

Moreover, the control device closes the electromagnetic valve 65 to block the second bypass circuit 42. Accordingly, all the refrigerant from the expansion valve 16 flows into the evaporator 17. The control device starts the operations of the fans 27, 29, and drives the driving element of the compressor 11. Accordingly, the low-pressure refrigerant gas is sucked and compressed by the first rotary compression element (not shown) of the compressor 11 to indicate an intermediate pressure, and is discharged into the sealed container 11A. The refrigerant discharged into the sealed container 11A is once discharged to the outside of the sealed container 11A from the refrigerant introducing tube 32, thereafter enters the intermediate cooling circuit 150, and passes through the heat exchanger 152. It is to be noted that since the fan 22 is not operated in the present mode, the heat radiation of the refrigerant in the heat exchanger 152 slightly or hardly occurs. Accordingly, the refrigerant sucked into the second rotary compression element can be held at high temperature. Therefore, the refrigerant discharged from the compressor 11 is at high temperature, the ambient air can be heated in the radiator 15, and accordingly the heating capability in the radiator 15 can be secured.

Thereafter, the refrigerant is sucked into the second rotary compression element, compressed to form a high-temperature/pressure refrigerant gas, and discharged to the outside of the compressor 11 from the refrigerant discharge tube 34. At this time, the refrigerant is compressed to an appropriate supercritical pressure. The refrigerant gas discharged from the compressor 11 passes through the gas cooler 12. Since the fan 22 is not operated as described above, the refrigerant in the gas cooler 12 slightly or hardly radiates heat. Moreover, since the electromagnetic valve 170 is closed, and the electromagnetic valve 172 is opened as described above, the refrigerant which has flown out of the gas cooler 12 enters the first bypass circuit 140 from the refrigerant pipe 36, and flows in the radiator 15. Here, the high-temperature/pressure refrigerant compressed by the compressor 11 does not condense, and is operated in a supercritical state. Moreover, the high-temperature/pressure refrigerant gas radiates the heat in the radiator 15. It is to be noted that the air heated by the heat radiation of the refrigerant in the radiator 15 is circulated in the storage chamber 5 by the operation of the fan 29 to thereby heat the inside of the storage chamber 5. In the present invention, since carbon dioxide is used as the refrigerant, the refrigerant does not condense in the radiator 15, therefore a heat exchange capability in the radiator 15 is remarkably high, and the air in the storage chamber 5 can be set at the high temperature.

Moreover, since the fan 22 is not operated as described above, the refrigerant hardly radiates heat in the heat exchanger 152 and gas cooler 12 of the intermediate cooling circuit 150, and the refrigerant maintained at the high temperature can radiate the heat in the radiator 15. Accordingly, the heating capability in the radiator 15 can be sufficiently secured.

Furthermore, the refrigerant enters the refrigerant pipe 36 on the outlet side of the electromagnetic valve 170 from the first bypass circuit 140, and passes through the internal heat exchanger 45. The heat of the refrigerant is taken by the refrigerant which has flown out of the evaporator 17 on the low-pressure side, and is further cooled. Moreover, the refrigerant gas on the high-pressure side cooled by the internal heat exchanger 45 reaches the expansion valve 16. It is to be noted that the refrigerant gas still has the supercritical state in the inlet of the expansion valve 16. The refrigerant is brought into a mixed state of two phases of gas/liquid by the pressure drop in the expansion valve 16, and flows in the evaporator 17 installed in the cooling chamber 2.

There, the refrigerant evaporates, and absorbs heat from the ambient air to thereby exert the cooling function. It is to be noted that the air cooled by the evaporation of the refrigerant in the evaporator 17 is circulated in the cooling chamber 2 to thereby cool the inside of the cooling chamber 2 by the operation of the fan 27. Moreover, the refrigerant flows out of the evaporator 17, enters the refrigerant pipe 38, and passes through the internal heat exchanger 45.

There, the refrigerant repeats a cycle of taking the heat from the refrigerant on the high-pressure side, receiving the heating function, and completely turning into the gas state to be sucked into the first rotary compression element of the compressor 11 from the refrigerant introducing tube 30.

Thus, when the cooling chamber 2 is partitioned off the storage chamber 5 by the insulating material 7, all the spaces in the storage chamber 5 can be heated by the radiator 15.

As described above in detail, also in the present embodiment, the inside of the storage chamber 5 can be heated by the radiator 15, and cooled by the evaporator 19 in the same manner as in the above-described embodiment. Accordingly, power consumption of the heating/cooling system 300 can be remarkably reduced.

Further in the present embodiment, the intermediate cooling circuit 150. the heat exchanger 152 for radiating the heat from the refrigerant compressed by the first rotary compression element, and the fan 22 for supplying air through the heat exchanger 152 and gas cooler 12 are disposed to thereby control the operation of the fan 22 as in the above-described respective modes. Accordingly, enhancement of the cooling capability, and maintenance of the heating capability can be realized. Accordingly, the performance of the heating/cooling system 300 can further be enhanced.

Moreover, when the gas cooler 12 is integrally formed with the heat exchanger 152 as in the present embodiment, an installation space can be reduced. Furthermore, since one fan 22 can be used in common, production cost can also be reduced.

It is to be noted that in the present embodiment, the gas cooler 12 is formed integrally with the heat exchanger 152 as described above, and the fan 22 is used in common, but the present invention is not limited to this embodiment. The gas cooler 12 may be disposed separately from the heat exchanger 152, and the fan may be disposed in the vicinity of the both.

It is to be noted that in the mode in which the chamber 4 or the whole storage chamber 5 of the above-described embodiment is used as the heating chamber for heating the articles, the electric heater 81 disposed in the chamber 4 may be operated to supplementarily perform the heating by the electric heater 81 in addition to the heating by the radiator 15. In this case, it is possible to avoid, in advance, a disadvantage that the chamber 4 or the storage chamber 5 cannot be sufficiently heated by shortage of the heating capability caused, for example, in winter. Since the electric heater 81 supplements the heating by the radiator 15, the capacity of the electric heater 81 can be reduced, and therefore the power consumption can be reduced as compared with the heating only by the electric heater.

Moreover, in the present embodiment, one storage chamber 5 is partitioned by the insulating material 7 to thereby form two chambers (chambers 3, 4) usable in such a manner as to be switched to be hot/cold, but the present invention is not limited to this. For example, three or more storage chambers are disposed, a radiator and an evaporator are disposed in the chambers excluding at least one storage chamber, the storage chamber in which any radiator or evaporator is not disposed communicates with the other storage chambers in such a manner that the chamber can be partitioned, and the chambers can be used in such a manner as to be switched to be hot/cold.

(Embodiment 4)

Figure 12:
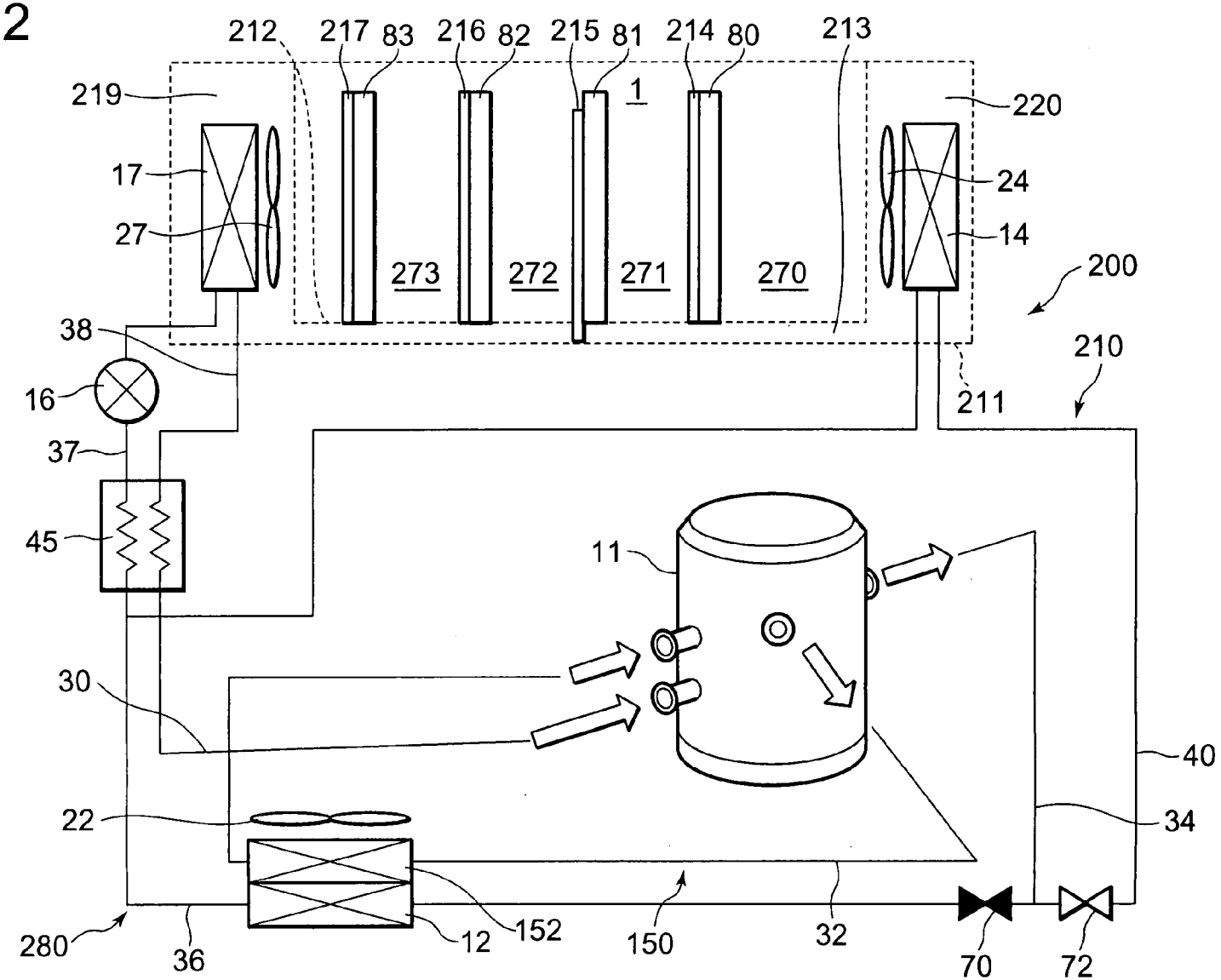
FIG. 12 is a refrigerant circuit diagram of an open showcase according to still another embodiment of the present invention (Embodiment 4)
Figure 13:
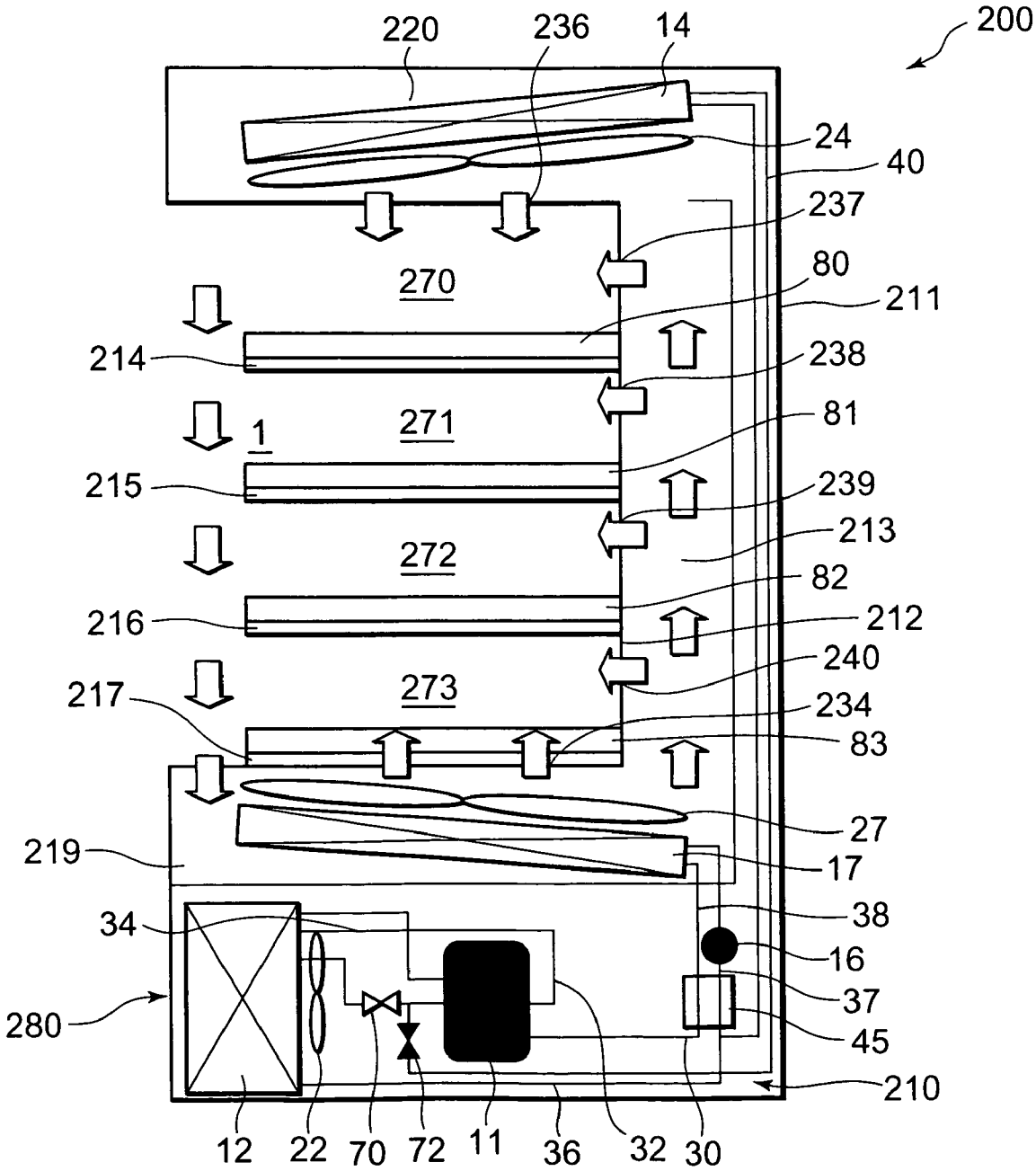
FIG. 13 is a longitudinal side view showing an operation in a mode in which storage chambers 270, 271, 272, and a chamber 273 of the open showcase of FIG. 12 are used as the cooling chambers.

Next, another embodiment of a heating/cooling system of the present invention will be described. FIG. 12 is a refrigerant circuit diagram in a case where the heating/cooling system of the present invention is applied to an open showcase 200, and FIGS. 13 to 16 show longitudinal side views of the open showcase 200. It is to be noted that in FIGS. 12 to 16, components denoted with the same reference numerals as those of FIGS. 4 to 11 produce similar effects.

The open showcase 200 of the present embodiment is a vertical type open showcase installed in shops such as a supermarket, and comprises an insulated wall 211 whose section substantially has a U-shape, and side plates (not shown) attached to opposite sides of the insulated wall. Inside the insulated wall 211, a partition plate 212 is attached, a duct 213 is formed between the insulated wall 211 and the partition plate 212, and the inside of the partition plate 212 is constituted as a storage chamber 1.

In the storage chamber 1, a plurality of stages (four stages in the embodiment) of shelves which are partition members are disposed, and spaces on shelves 214, 215, 216, 217 are constituted as storage chambers 270, 271, 272 for storing articles, and a chamber 273. Electric heaters 80, 81, 82, 83 for heating the respective storage chambers 270, 271, 272 and the chamber 273 are attached onto the respective shelves 214, 215, 216, 217. The electric heaters 80, 81, 82 are disposed in such a manner as to compensate for shortage of the capability of the radiator 14 because of the heating as described later. It is to be noted that the electric heater 83 is disposed in such a manner as to heat the chamber 273.

Suction ports 230, 232 (not shown in FIG. 12) are formed in upper and lower edges of a front face opening of the storage chamber 1, the suction port 230 is connected to an upper duct 220 described later, and the suction port 232 is connected to a bottom duct 219 described later.

On the other hand, a deck pan (not shown) is attached to a bottom part of the storage chamber 1, the bottom duct 219 connected to the duct 213 is constituted below the deck pan, and an evaporator 17 and a fan 27 for cooling the respective storage chambers 270, 271, 272, and the chamber 273 are disposed in the bottom duct 219. Moreover, holes 234, 234 vertically extending through the chamber 273 and the bottom duct 219 are formed in the deck pan in such a manner that the air which has exchanged the heat with the evaporator 17 is sent into the chamber 273 by the fan 27.

On the other hand, the upper duct 220 is similarly formed in such a manner as to communicate with the duct 213 in an upper part of the storage chamber 1. A radiator 14 and a fan 24 for heating the respective storage chambers 270, 271, 272 are disposed in the upper duct 220. Vertically extending through-holes 236 are formed in the storage chamber 270 and the upper duct 220 in such a manner that the air which has exchanged the heat with the evaporator 14 is sent into the chamber 270 from the holes 236, 236 by the fan 24.

Furthermore, communication holes 237, 238, 239, 240 for connecting the duct 213 to the storage chambers 270, 271, 272 and the chamber 273 are formed in the partition plate 212, and the air which has exchanged the heat with the evaporator 14 is sent into the respective storage chambers 270, 271, 272 and the chamber 273 from the respective communication paths 237, 238, 239, 240 via the duct 213 by the respective fans 27, 24.

Here, the shelves 214, 215, 216 may extend through the duct 213 in such a manner as to vertically partition the duct 213 in an insulating manner. That is, holes (not shown) are formed in back surfaces (on the side of the duct 213 in FIGS. 13 to 16) of the respective shelves 214, 215, 216 in such a manner that the respective shelves 214, 215, 216 can be inserted in the duct 213. When the shelf 214, 215, or 216 is inserted in the duct 213 through the hole, each flow of air in the duct 213 can be interrupted. Therefore, one chamber (upper side) partitioned by the shelf 214, 215, or 216 can be heated by the radiator 14, and the other chamber (lower side) can be cooled by the evaporator 17.

On the other hand, a machine chamber 280 is formed under the bottom duct 219, and a compressor 11, a gas cooler 12, an internal heat exchanger 45, an expansion valve 16 which is a pressure reducing device and the like, constituting a part of a refrigerant circuit 210 described later, are stored in the machine chamber 280. It is to be noted that the compressor 11 for use in the present embodiment is a two-stage compression system compressor, and comprises a driving element, and first and second compression elements driven by the driving element. The gas cooler 12 radiates heat from a high-temperature/pressure refrigerant discharged from the compressor 11, and a fan 22 is disposed in the vicinity of the gas cooler 12.

Here, the refrigerant circuit 210 will be described with reference to FIG. 12. The refrigerant circuit 210 is constituted by piping/connecting the compressor 11, gas cooler 12, expansion valve 16, evaporator 17 and the like in an annular shape. That is, a refrigerant discharge tube 34 of the compressor 11 is connected to an inlet of the gas cooler 12. A refrigerant pipe 36 connected to the outlet side of the gas cooler 12 extends through the internal heat exchanger 45. It is to be noted that the internal heat exchanger 45 exchanges heat between the refrigerant on a high-pressure side, and the refrigerant on a low-pressure side. A refrigerant pipe 37 connected to the outlet of the internal heat exchanger 45 is connected to an inlet of the evaporator 17 disposed in the bottom duct 219 via the expansion valve 16. A refrigerant pipe 38 extending from the evaporator 17 extends through the internal heat exchanger 45, and is connected to a refrigerant introducing tube 30. It is to be noted that the refrigerant introducing tube 30 is connected to a first compression element of the compressor 11 in such a manner that a low-pressure refrigerant is sucked into the compressor 11.

Moreover, in FIG. 12, reference numeral 32 denotes a refrigerant introducing tube for introducing the refrigerant compressed by the first rotary compression element of the compressor 11 to the second rotary compression element. The refrigerant introducing tube 32 is disposed in such a manner as to extend through an intermediate cooling circuit 150 disposed outside a sealed container. The intermediate cooling circuit 150 is provided with a heat exchanger 152 for cooling the refrigerant compressed by the first compression element, and the heat exchanger 152 is constituted integrally with the gas cooler 12.

Here, a first bypass circuit 40 is branched from a middle portion of the refrigerant discharge tube 34, and an outlet of the first bypass circuit 40 is connected to the middle portion of the refrigerant pipe 36. The first bypass circuit 40 is disposed in such a manner as to extend through the radiator 14 disposed in the upper duct 220. On the inlet side of the radiator 14 of the first bypass circuit 40, and in the refrigerant discharge tube 34, electromagnetic valves 70, 72 are disposed as channel control means for controlling the refrigerant on the high-pressure side compressed by the second compression element of the compressor 11 in such a manner as to be passed through the gas cooler 12 or the first bypass circuit 40 from the refrigerant discharge tube 34. The valves are controlled to open/close by a control device (not shown).

It is to be noted that carbon dioxide is sealed as refrigerant in the refrigerant circuit 210, and the refrigerant circuit 210 has a supercritical pressure on the high-pressure side.

(1) Mode to Use Storage Chambers 270, 271, 272 and Chamber 273

Next, an operation of the open showcase 200 constituted as described above will be described. First, the operation in a mode to use the storage chambers 270, 271, 272 and chamber 273 as the cooling chambers for cooling articles will be described with reference to FIG. 13.

It is to be noted that in this mode the shelf 214, 215, or 216 is not inserted in the duct 213. The electromagnetic valve 70 is opened, the electromagnetic valve 72 is closed, and the first bypass circuit 40 is blocked by the control device (not shown). Accordingly, all the refrigerant discharged from the compressor 11 flows in the gas cooler 12 from the refrigerant discharge tube 34 without flowing in the first bypass circuit 40. It is to be noted that in FIGS. 13 to 16 described hereinafter, a white electromagnetic valve indicates a state in which the valve is opened by the control device, and a black electromagnetic valve indicates a state in which the valve is closed by the control device.

Moreover, the control device starts the operations of the machine chamber 280, and the fans 22, 27, 24 stored in the bottom duct 219 and upper duct 220, and drives the driving element of the compressor 11. Accordingly, the low-pressure refrigerant gas is sucked and compressed by the first compression element (not shown) of the compressor 11 from the refrigerant introducing tube 30 to indicate an intermediate pressure, once discharged to the outside of the sealed container from the refrigerant introducing tube 32, and enters the intermediate cooling circuit 150, and passes through the heat exchanger 152 disposed in the circuit. Moreover, the refrigerant is subjected to air passing by the fan 22, and radiates heat while passing through the heat exchanger 152, constitutes a high-temperature/pressure refrigerant gas, and is discharged to the outside of the compressor 11 from the refrigerant discharge tube 34. At this time, the refrigerant is compressed to an optimum supercritical pressure.

The refrigerant gas discharged from the compressor 11 flows into the gas cooler 12 from the refrigerant discharge tube 34, because the electromagnetic valve 70 is opened, and the electromagnetic valve 72 is closed. Here, the high-temperature/pressure refrigerant compressed by the compressor 11 does not condense, and operation is performed in a supercritical state. Moreover, the high-temperature/pressure refrigerant gas receives the air passing by the fan 22 to radiate the heat. Since carbon dioxide is used as the refrigerant in the present invention, the refrigerant does not condense in the gas cooler 12, flows out of the gas cooler 12 still in the supercritical state, enters the refrigerant pipe 36, and passes through the internal heat exchanger 45.

The heat of the refrigerant is taken by the refrigerant which has flown out of the evaporator 17 on the low-pressure side, and the refrigerant is further cooled. By the presence of the internal heat exchanger 45, the heat of the refrigerant flowing out of the gas cooler 12 and passing through the internal heat exchanger 45 is taken by the refrigerant on the low-pressure, and therefore supercooling degree of the refrigerant increases the more. Therefore, the cooling capability in the evaporator 17 is enhanced.

The refrigerant gas cooled by the internal heat exchanger 45 on the high-pressure side reaches the expansion valve 16. It is to be noted that the refrigerant gas still has a supercritical state in the inlet of the expansion valve 16. The refrigerant is brought into a two-phase mixed state of a gas/liquid by pressure drop in the expansion valve 16. Moreover, the refrigerant brought into the two-phase mixed state flows into the evaporator 17 disposed in the bottom duct 219. There, the refrigerant evaporates, and absorbs the heat from ambient air to thereby exert a cooling function. It is to be noted that the air cooled by the evaporation of the refrigerant in the evaporator 17 enters the chamber 273 via the holes 234, 234 by the operation of the fan 27 to thereby cool the inside of the chamber 273. Furthermore, the air cooled by the evaporator 17 enters the duct 213 and the upper duct 220 by the operation of the fan 27, and is sent to the storage chambers 270, 271, 272 and the chamber 273 from the respective communication holes 237, 238, 239, 240 and the holes 236, 236 to thereby cool the respective storage chambers 270, 271, 272 and chamber 273.

Moreover, by an effect to cool the refrigerant compressed by the first compression element by the heat exchanger 152 as described above, and an effect to pass the refrigerant discharged from the gas cooler 12 on the high-pressure side through the internal heat exchanger 45 to cool the refrigerant, the refrigerant evaporates at lower temperature by the evaporator 17. Accordingly, the storage chambers 270, 271, 272 and the chamber 273 can be cooled at lower temperature, and the cooling capability can be enhanced.

It is to be noted that the air (cold air) sent to the storage chambers 270, 271, 272 and the chamber 273 repeats a cycle of cooling the storage chambers 270, 271, 272 and the chamber 273, thereafter being sucked into the bottom duct 219 from the suction port 232, and cooled in the evaporator 17.

On the other hand, the refrigerant which has evaporated in the evaporator 17 flows out of the evaporator 17, flows in the refrigerant pipe 38, and passes through the internal heat exchanger 45. Then, the refrigerant repeats a cycle of taking the heat from the refrigerant on the high-pressure side, and receiving the heating function to completely turn to a gas state to be sucked into the first compression element of the compressor 11 from the refrigerant introducing tube 30.

Figure 14:
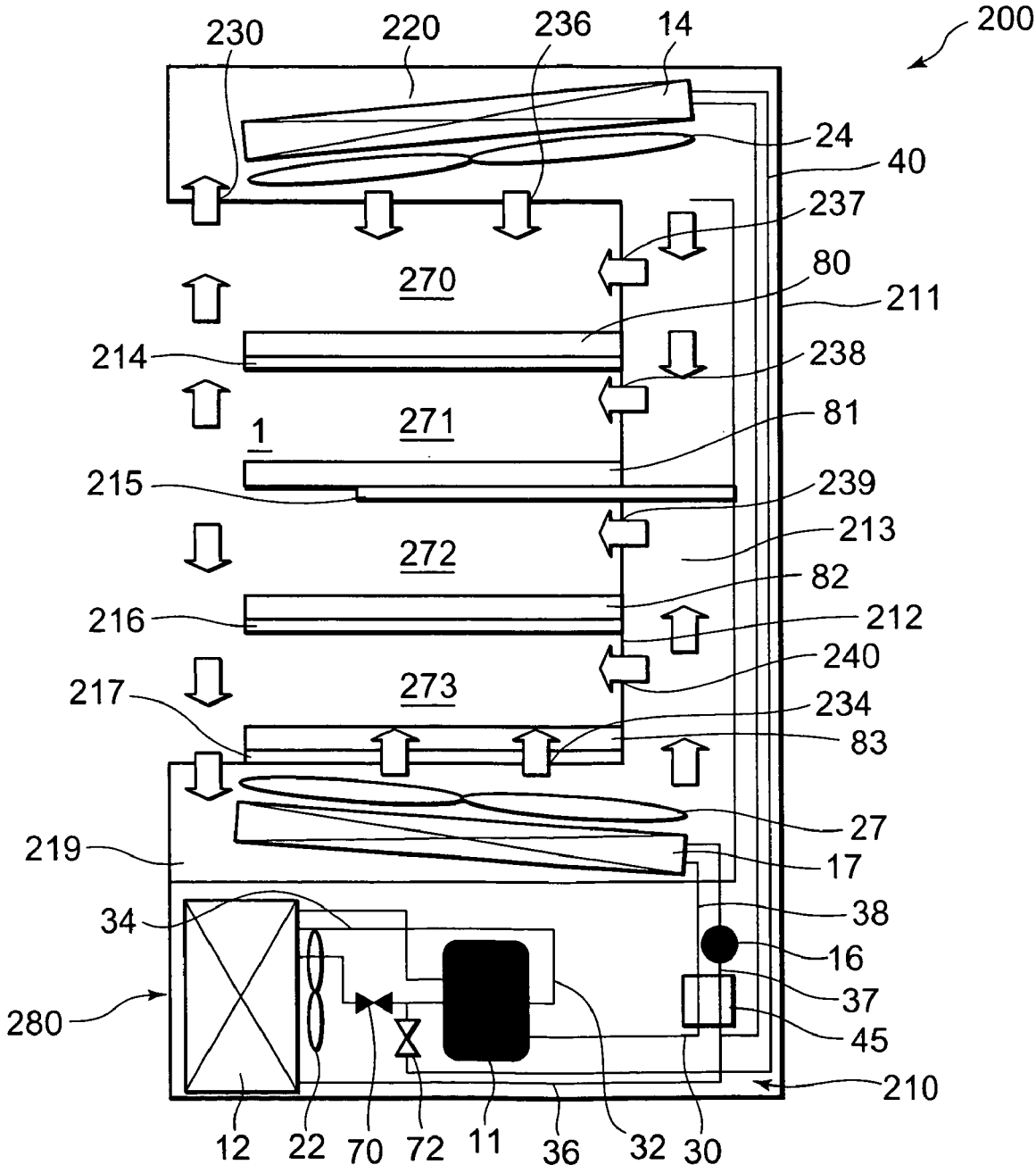
FIG. 14 is a longitudinal side view showing an operation in a mode in which the storage chambers 270, 271 are used as the heating chambers, and the storage chamber 272 and the chamber 273 are used as the cooling chamber in the open showcase of FIG. 12.

(2) Mode to Use Storage Chambers 270, 271 as Heating Chambers and Use Storage Chamber 272 and Chamber 273 as Cooling Chambers Next, an operation in a mode in which the storage chambers 270 and 271 are used as the heating chambers for heating the articles, and the storage chamber 272 and the chamber 273 are used as the cooling chambers for cooling the articles will be described with reference to FIG. 14.

When the shelf 215 is inserted in the duct 213 by an operator (at this time, the shelves 214, 216 are not inserted in the duct 213), the duct 213 is vertically partitioned by the shelf 215. Accordingly, the storage chambers 270, 271 position on one side (upper side) of the shelf 215 are heated by the radiator 14, and the storage chamber 272 and the chamber 273 positioned on the other side (lower side) can be cooled by the evaporator 17.

Moreover, the electromagnetic valve 70 is closed, and the electromagnetic valve 72 is opened to thereby open the first bypass circuit 40 by the control device (not shown). Accordingly, the refrigerant discharged from the compressor 11 does not flow in the gas cooler 12, and all flows in the first bypass circuit 40 from the refrigerant discharge tube 34.

Furthermore, the control device starts operations of the electric heaters 80, 81 disposed on the shelves 214, 215 of the storage chambers 270, 271. Accordingly, the storage chambers 270, 271 are heated. The control device starts the operations of the fans 27, 24. At this time, it is assumed that the fan 22 does not operate. Furthermore, the control device drives the driving element of the compressor 11. Accordingly, the low-pressure refrigerant gas is sucked into the first rotary compression element (not shown) of the compressor 11 from the refrigerant introducing tube 30, compressed to indicate an intermediate pressure, and once discharged to the outside of the sealed container from the refrigerant introducing tube 32. The refrigerant enters the intermediate cooling circuit 150. While passing through the heat exchanger 152 the refrigerant radiates the heat. However, since the fan 22 is not operated in the present mode, the heat radiation of the refrigerant in the heat exchanger 152 slightly or hardly occurs. Thus, the refrigerant sucked into the second rotary compression element can be held at high temperature. Therefore, since the refrigerant discharged from the compressor 11 is at high temperature, and the ambient air can be heated at high temperature in the radiator 14, the heating capability in the radiator 14 can be secured.

Thereafter, the refrigerant is sucked into the second rotary compression element, compressed to form a high-temperature/pressure refrigerant gas, and discharged to the outside of the compressor 11 from the refrigerant discharge tube 34. At this time, the refrigerant is compressed to an appropriate supercritical pressure.

Since the electromagnetic valve 70 is closed, and the electromagnetic valve 72 is opened as described above, the refrigerant gas discharged the compressor 11 flows in the radiator 14 disposed in the upper duct 220 from the middle portion of the refrigerant discharge tube 34 via the first bypass circuit 40. Here, the high-temperature/pressure refrigerant compressed by the compressor 11 does not condense, and is operated in a supercritical state. Moreover, the high-temperature/pressure refrigerant gas radiates the heat in the radiator 14. It is to be noted that the ambient air heated by the heat radiation of the refrigerant in the radiator 14 enters the storage chamber 270 from the holes 236, 236 by the operation of the fan 24 to thereby heat the heating chamber 270. Furthermore, the air heated by the radiator 14 enters the storage chambers 270, 271 from the communication holes 237, 238 via the duct 213 by the fan 24 to heat the storage chambers 270, 271. In the present invention, since carbon dioxide is used as the refrigerant, the refrigerant does not condense in the radiator 14, therefore a heat exchange capability in the radiator 14 is remarkably high, and the air in the storage chambers 270, 271 can be set at the sufficiently high temperature.

Moreover, the air (hot air) sent by the fan 24 is not sent below the shelf 215, because the duct 213 is partitioned by the shelf 215 as described above. Accordingly, the storage chambers 270, 271 which are chambers above the shelf 215 can be heated.

On the other hand, the air (hot air) sent to the storage chambers 270, 271 repeats a cycle of heating the storage chambers 270, 271, and being thereafter sucked into the upper duct 220 from the suction port 230, and heated again in the radiator 14.

On the other hand, the refrigerant which has radiated the heat in the radiator 14 enters the refrigerant pipe 36 from the first bypass circuit 40, and passes through the internal heat exchanger 45. There, the heat of the refrigerant is taken by the refrigerant which has flown out of the evaporator 17 on the low-pressure side, and the refrigerant is further cooled. By the presence of this internal heat exchanger 45, the heat of the refrigerant which has flown out of the radiator 14 and passes through the internal heat exchanger 45 is taken by the refrigerant on the low-pressure side, and supercooling degree of the refrigerant increases the more. Therefore, the cooling capability in the evaporator 17 is enhanced.

The refrigerant gas cooled by the internal heat exchanger 45 on the high-pressure side reaches the expansion valve 16. It is to be noted that the refrigerant gas still has a supercritical state in the inlet of the expansion valve 16. The refrigerant is brought into a two-phase mixed state of a gas/liquid by pressure drop in the expansion valve 16. Moreover, the refrigerant brought into the two-phase mixed state flows into the evaporator 17 disposed in the bottom duct 219. There, the refrigerant evaporates, and absorbs the heat from ambient air to thereby exert a cooling function. It is to be noted that the air cooled by the evaporation of the refrigerant in the evaporator 17 enters the chamber 273 from the holes 234, 234 by the operation of the fan 27 to cool the inside of the chamber 273. Furthermore, the air cooled by the evaporator 17 enters the duct 213, and is sent to the storage chamber 272 and the chamber 273 from the communication holes 239 and 240 by the operation of the fan 27 to thereby control the insides of the storage chamber 272 and chamber 273.

Here, the air (cold air) sent by the fan 27 is not sent above the shelf 215, because the duct 213 is partitioned by the shelf 215 as described above. Accordingly, the storage chamber 272 and the chamber 273 which are chambers below the shelf 215 can be cooled.

It is to be noted that a cycle in which the air (cold air) sent to the storage chamber 272 and the chamber 273 cools the storage chamber 272 and the chamber 273, and is thereafter sucked into the bottom duct 219 from the suction port 232, and cooled again in the evaporator 17 is repeated.

On the other hand, the refrigerant evaporated in the evaporator 17 flows out of the evaporator 17, enters the refrigerant pipe 38, and passes through the internal heat exchanger 45. There, a cycle is repeated in which the refrigerant takes the heat from the refrigerant on the high-pressure side, receives the heating function to completely turn into a gas state, and is sucked into the first compression element of the compressor 11 from the refrigerant introducing tube 30.

Figure 15:
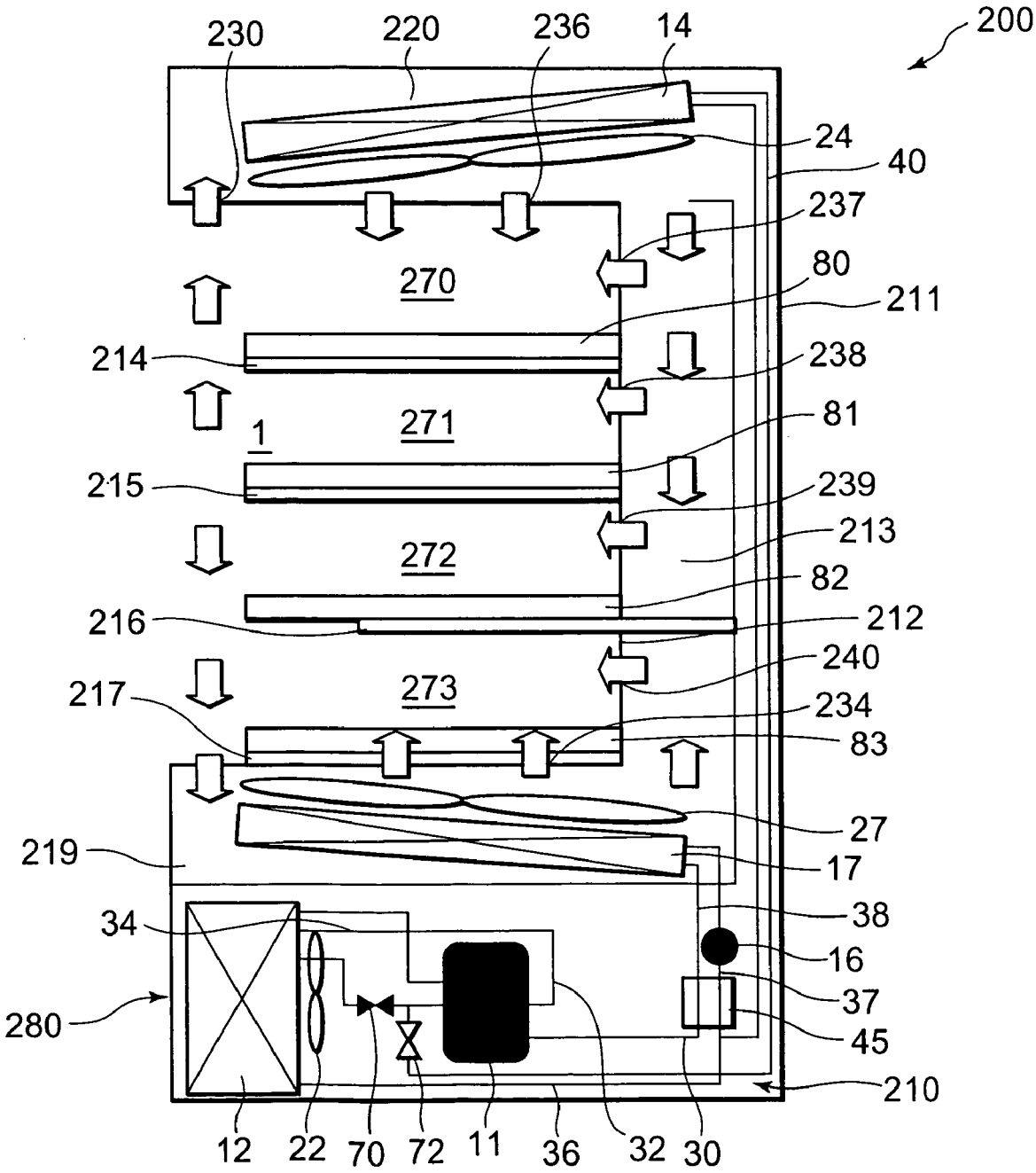
FIG. 15 is a longitudinal side view showing an operation in a mode in which the storage chambers 270, 271, 272 are used as the heating chambers, and the storage chamber 273 is used as the cooling chamber in the open showcase of FIG. 12.
Figure 16:
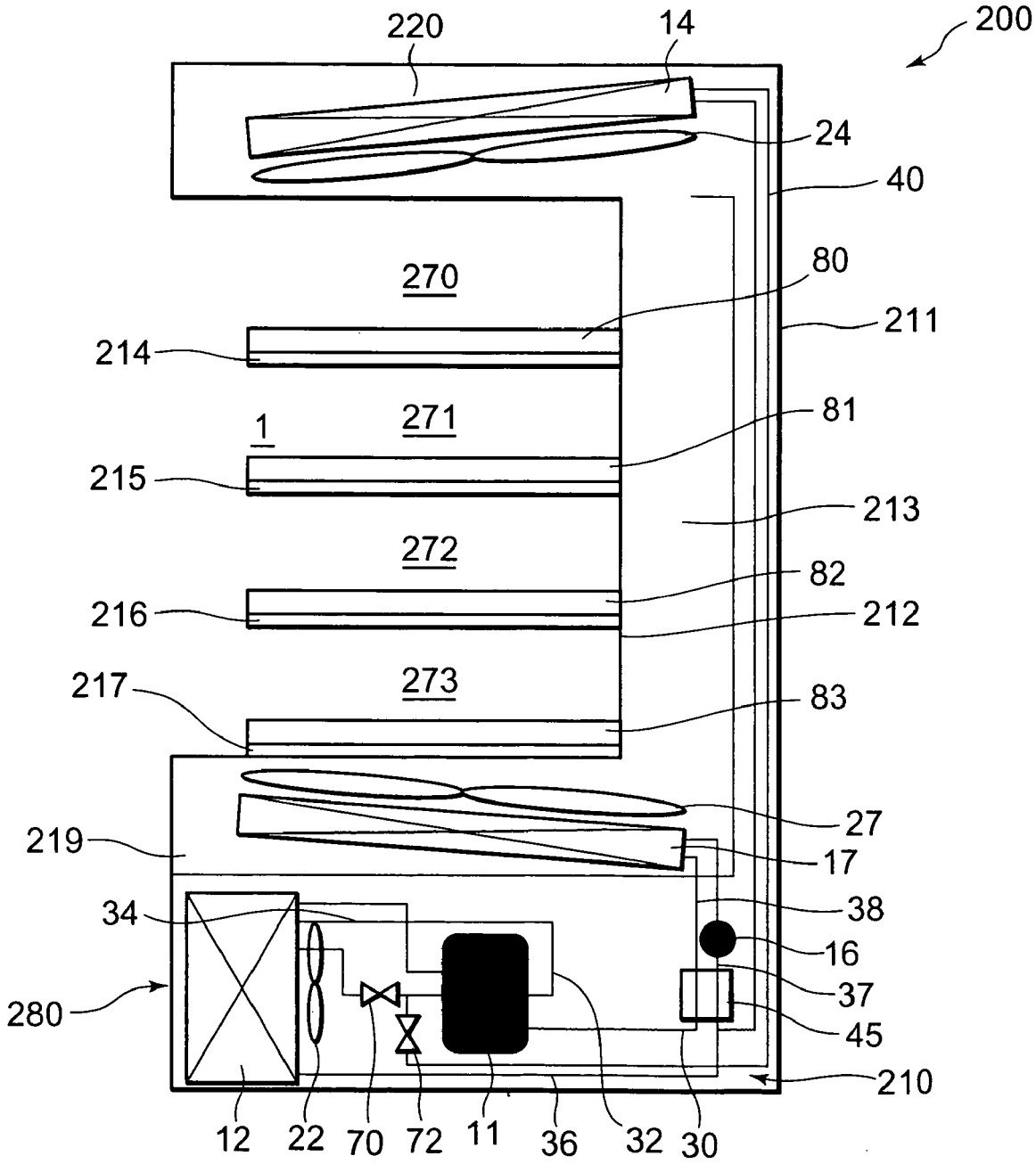
FIG. 16 is a longitudinal side view showing a mode in which the storage chambers 270, 271, 272 and the chamber 273 are used as the heating chambers in the open showcase of FIG. 12.
Figure 17:
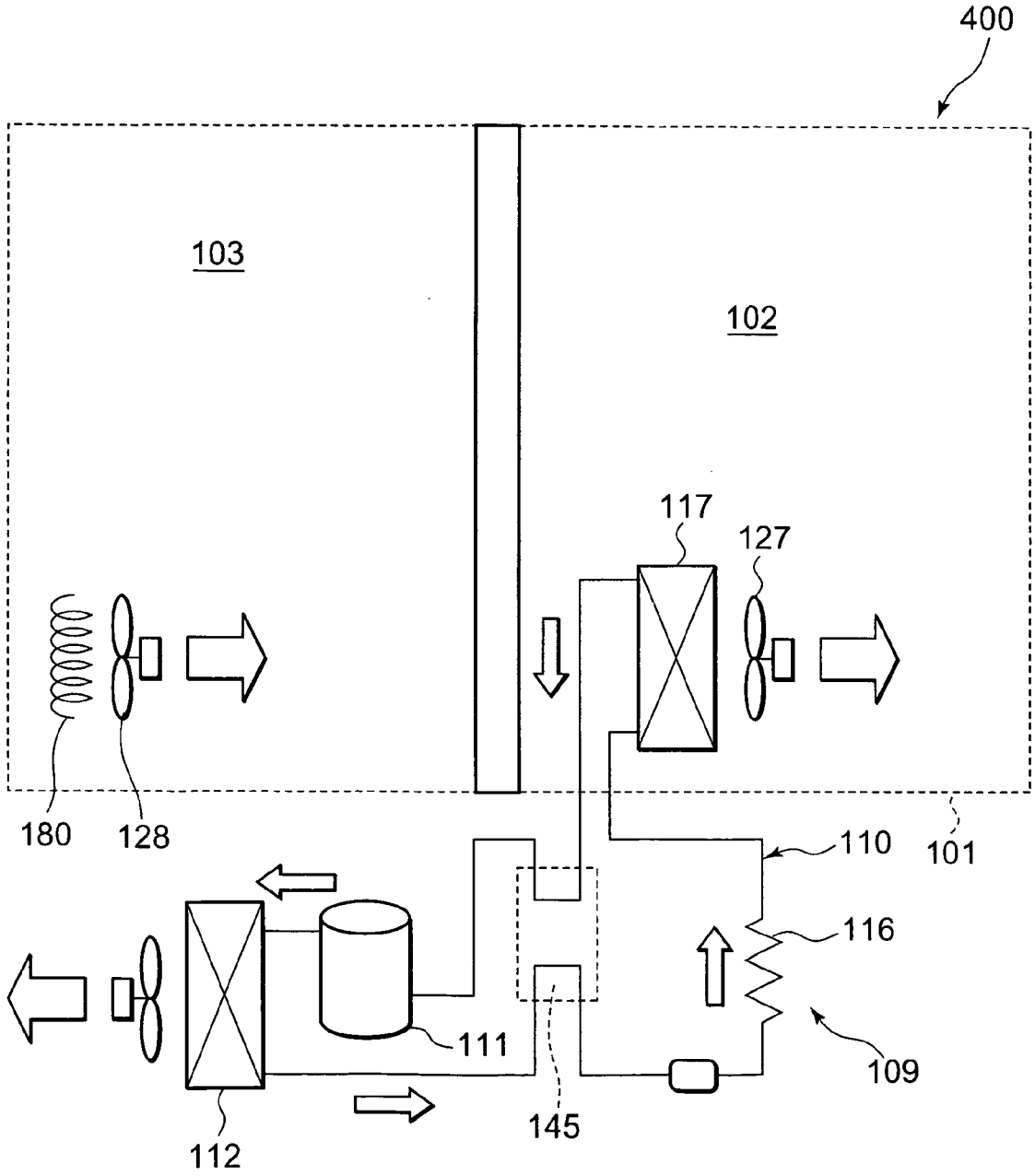
FIG. 17 PRIOR ART
FIG. 17 is an internal constitution diagram of a conventional heating/cooling system.

(3) Mode to Use Storage Chambers 270, 271, 272 as Heating Chambers and Use Chamber 273 as Cooling Chamber Next, an operation in a mode in which the storage chambers 270, 271, 272 are used as the heating chambers for heating the articles, and the chamber 273 is used as the cooling chamber for cooling the articles will be described with reference to FIG. 15.

When the shelf 216 is inserted in the duct 213 by the operator (at this time, the shelves 214, 215 are not inserted in the duct 213), the duct 213 is vertically partitioned by the shelf 216. Accordingly, the storage chambers 270, 271, 272 position on one side (upper side) of the shelf 216 are heated by the radiator 14, and the chamber 273 positioned on the other side (lower side) can be cooled by the evaporator 17.

Moreover, the electromagnetic valve 70 is closed, and the electromagnetic valve 72 is opened to thereby open the first bypass circuit 40 by the control device (not shown). Accordingly, the refrigerant discharged from the compressor 11 does not flow in the gas cooler 12, and all flows in the first bypass circuit 40 from the refrigerant discharge tube 34.

Furthermore, the control device starts operations of the electric heaters 80, 81, 82 disposed on the shelves 214, 215, 216 of the storage chambers 270, 271, 272. Accordingly, the storage chambers 270, 271, 272 are heated. The control device starts the operations of the fans 27, 24 stored in the bottom duct 219 and upper duct 220. At this time, it is assumed that the fan 22 does not operate. Furthermore, the control device drives the driving element of the compressor 11. Accordingly, the low-pressure refrigerant gas is sucked into the first compression element (not shown) of the compressor 11 from the refrigerant introducing tube 30, compressed to indicate an intermediate pressure, and once discharged to the outside of the sealed container from the refrigerant introducing tube 32. The refrigerant enters the intermediate cooling circuit 150. While passing through the heat exchanger 152, the refrigerant radiates the heat. However, since the fan 22 is not operated in the present mode in the same manner as in the above-described mode, the heat radiation of the refrigerant in the heat exchanger 152 slightly or hardly occurs.

Accordingly, the refrigerant sucked into the second compression element can be held at high temperature. Therefore, since the refrigerant discharged from the compressor 11 is at high temperature, and the ambient air can be heated at high temperature in the radiator 14, the heating capability in the radiator 14 can be maintained.

Thereafter, the refrigerant is sucked into the second compression element, compressed to form a high-temperature/pressure refrigerant gas, and discharged to the outside of the compressor 11 from the refrigerant discharge tube 34. At this time, the refrigerant is compressed to an appropriate supercritical pressure.

Since the electromagnetic valve 70 is closed, and the electromagnetic valve 72 is opened as described above, the refrigerant gas discharged the compressor 11 flows in the radiator 14 disposed in the upper duct 220 from the middle portion of the refrigerant discharge tube 34 via the first bypass circuit 40. Here, the high-temperature/pressure refrigerant compressed by the compressor 11 does not condense, and is operated in a supercritical state. Moreover, the high-temperature/pressure refrigerant gas radiates the heat in the radiator 14. It is to be noted that the ambient air heated by the heat radiation of the refrigerant in the radiator 14 enters the storage chamber 270 from the holes 236, 236 by the operation of the fan 24 to thereby heat the heating chamber 270. Furthermore, the air heated by the radiator 14 enters the storage chambers 270, 271, 272 from the communication holes 237, 238, 239 via the duct 213 by the fan 24 to heat the storage chambers 270, 271, 272. In the present invention, since carbon dioxide is used as the refrigerant, the refrigerant does not condense in the radiator 14, therefore a heat exchange capability in the radiator 14 is remarkably high, and the air in the storage chambers 270, 271, 272 can be set at the sufficiently high temperature.

Moreover, the air (hot air) sent by the fan 24 is not sent below the shelf 216, because the duct 213 is partitioned by the shelf 216 as described above. Accordingly, the storage chambers 270, 271, 272 which are chambers above the shelf 216 can be heated.

On the other hand, the air (hot air) sent to the storage chambers 270, 271, 272 repeats a cycle of heating the storage chambers 270, 271, 272, and being thereafter sucked into the upper duct 220 from the suction port 230, and heated again in the radiator 14.

On the other hand, the refrigerant which has radiated the heat in the radiator 14 enters the refrigerant pipe 36 from the first bypass circuit 40, and passes through the internal heat exchanger 45. There, the heat of the refrigerant is taken by the refrigerant which has flown out of the evaporator 17 on the low-pressure side, and the refrigerant is further cooled. By the presence of this internal heat exchanger 45, the heat of the refrigerant which has flown out of the radiator 14 and passes through the internal heat exchanger 45 is taken by the refrigerant on the low-pressure side, and supercooling degree of the refrigerant increases the more. Therefore, the cooling capability in the evaporator 17 is enhanced.

The refrigerant gas cooled by the internal heat exchanger 45 on the high-pressure side reaches the expansion valve 16. It is to be noted that the refrigerant gas still has a supercritical state in the inlet of the expansion valve 16. The refrigerant is brought into a two-phase mixed state of a gas/liquid by pressure drop in the expansion valve 16. Moreover, the refrigerant brought into the two-phase mixed state flows into the evaporator 17 disposed in the bottom duct 219. There, the refrigerant evaporates, and absorbs the heat from ambient air to thereby exert a cooling function. It is to be noted that the air cooled by the evaporation of the refrigerant in the evaporator 17 enters the chamber 273 from the holes 240 via the holes 234, 234 or the duct 213 by the operation of the fan 27 to cool the inside of the chamber 273.

Here, the air (cold air) sent by the fan 27 is not sent above the shelf 216, because the duct 213 is partitioned by the shelf 216 as described above. Accordingly, the only chamber 273 which is the chamber below the shelf 216 can be cooled.

It is to be noted that a cycle in which the air (cold air) sent to the chamber 273 cools the chamber 273, and is thereafter sucked into the bottom duct 219 from the suction port 232, and cooled again in the evaporator 17 is repeated.

On the other hand, the refrigerant evaporated in the evaporator 17 flows out of the evaporator 17, enters the refrigerant pipe 38, and passes through the internal heat exchanger 45. There, a cycle is repeated in which the refrigerant takes the heat from the refrigerant on the high-pressure side, receives the heating function to completely turn into a gas state, and is sucked into the first compression element of the compressor 11 from the refrigerant introducing tube 30.

(4) Mode to Use Storage Chambers 270, 271, 272 and Chamber 273 as Heating Chambers Finally, a mode to use the storage chambers 270, 271, 272 and the chamber 273 as heating chambers for heating articles will be described. In a state in which the operation of the compressor 11 is stopped, the control device (not shown) starts the operations of the respective electric heaters 80, 81, 82, 83 disposed on the respective shelves 214, 215, 216, 217 to heat the respective storage chambers 270, 271, 272 and the chamber 273. Accordingly, the storage chambers 270, 271, 272 and the chamber 273 can be heated.

As described above, also in the present embodiment, outside the storage chambers 270, 271, 272 and the chamber 273, the radiator 14, the evaporator 17, and the fans 24, 27 for sending the air which has exchanged the heat with the radiator 14 and evaporator 17 are disposed, and the heating/cooling of each storage chamber can be switched.

Moreover, in addition to the heating by the radiator 14, when the electric heater is used, the storage chambers 270, 271, 272 can be sufficiently heated. Thus, when the electric heater is used in a supplementary manner in addition to the heating by the radiator 14, power consumption can be reduced.

Furthermore, in the present embodiment, in the mode to use all the chambers (storage chambers 270, 271, 272 and chamber 273) as the heating chambers, the operation of the compressor 11 is stopped, and all the chambers 270, 271, 272, 273 are heated only by the respective electric heaters 80, 81, 82, 83. However, an evaporator for evaporating the refrigerant is disposed separately from the evaporator 17 in the refrigerant circuit 210. Furthermore, the channel control means for controlling the refrigerant circulation are disposed in the pipes on the inlet sides of both the evaporators. When the refrigerant is not passed through the evaporator 17, and is passed through the separately disposed evaporator to evaporate the refrigerant by the channel control means, all the chambers 270, 271, 272, 273 can be heated by the radiator 14.

What is claimed is:

1. A heating/cooling system having a storage chamber usable in such a manner as to be switched to be hot/cold, comprising:

a refrigerant circuit comprising a compressor, a gas cooler, a pressure reducing device, an evaporator and the like, containing carbon dioxide sealed as a refrigerant therein, and having a supercritical pressure on a high-pressure side;

a radiator through which the refrigerant flowing out of the gas cooler flows before entering the pressure reducing device; and an air blower which sends air through the gas cooler, the inside of the storage chamber being heated by the radiator, the inside of the storage chamber being cooled by the evaporator, and the air blower being stopped in a case where the inside of the storage chamber is heated by the radiator.

2. The heating/cooling system according to claim 1, wherein the compressor comprises: first and second compression elements, the refrigerant compressed by the first compression element being compressed by the second compression element; and an intermediate cooling circuit comprising a heat exchanger for cooling the refrigerant compressed by the first compression element, and allowing the second compression element to suck the refrigerant, and the heat exchanger is integrally disposed in the gas cooler.

3. The heating/cooling system according to claim 1 or 2, further comprising: an internal heat exchanger for exchanging the heat between the refrigerant which has flown out of the gas cooler and the refrigerant which has flown out of the evaporator, the refrigerant being passed through the radiator before reaching the internal heat exchanger.

4. The heating/cooling system according to claim 1 or 2, further comprising: channel control means for controlling refrigerant circulation into the radiator and the evaporator; and an evaporator separately disposed for passing the refrigerant through the radiator, and evaporating the refrigerant in a case where the refrigerant circulation into the evaporator is interrupted.

5. A heating/cooling system having a storage chamber usable in such a manner as to be switched to be hot/cold, comprising:

a refrigerant circuit comprising a compressor, a radiator, a pressure reducing device, an evaporator and the like, containing carbon dioxide sealed as a refrigerant therein, and having a supercritical pressure on a high-pressure side; and a partition member capable of dividing the storage chamber in an insulated manner so that the inside of the storage chamber is heated by the radiator, and cooled by the evaporator, the partition member dividing the storage chamber in such a manner that one chamber is heated by the radiator, and the other chamber is cooled by the evaporator.

6. The heating/cooling system according to claim 5, a gas cooler for radiating heat from the refrigerant; a separate evaporator for evaporating the refrigerant; and channel control means for controlling refrigerant circulation with respect to the radiator, the gas cooler, and both the evaporators.

7. The heating/cooling system according to claim 5 or 6, wherein the compressor comprises: first and second compression elements; and an intermediate cooling circuit for cooling the refrigerant compressed by the first compression element of the compressor, and thereafter allowing the second compression element to suck the refrigerant, and the cooling of the refrigerant in the intermediate cooling circuit is substantially invalidated in a case where the inside of the storage chamber is heated by the radiator.

* * * * *